US006629889B2

(12) United States Patent
Mothwurf

(10) Patent No.: US 6,629,889 B2
(45) Date of Patent: Oct. 7, 2003

(54) APPARATUS AND METHOD FOR DATA GATHERING IN GAMES OF CHANCE

(75) Inventor: Ewald Mothwurf, Graz (AT)

(73) Assignee: Grips Electronic GmbH, Graz (AT)

( * ) Notice: Subject to any disclaimer, the term of this patent is extended or adjusted under 35 U.S.C. 154(b) by 14 days.

(21) Appl. No.: 09/281,830

(22) Filed: Mar. 30, 1999

(65) Prior Publication Data

US 2002/0151352 A1 Oct. 17, 2002

Related U.S. Application Data

(63) Continuation of application No. 08/573,618, filed on Dec. 15, 1995, now Pat. No. 5,919,090.

(30) Foreign Application Priority Data

Sep. 14, 1995 (AT) ..... 1529/95
Nov. 3, 1995 (AT) ..... 1820/95

(51) Int. Cl.[7] ..... A63F 9/24
(52) U.S. Cl. ..... 463/25; 463/12; 273/309
(58) Field of Search ..... 273/309, 237, 273/288; 463/11, 12, 13, 25, 26, 27, 16

(56) References Cited

U.S. PATENT DOCUMENTS

| | | | | |
|---|---|---|---|---|
| 4,531,187 A | | 7/1985 | Uhland | |
| 4,614,342 A | | 9/1986 | Takashima | |
| 4,755,941 A | | 7/1988 | Bacchi | |
| 5,078,405 A | | 1/1992 | Jones | |
| 5,393,067 A | * | 2/1995 | Paulsen et al. | 273/309 |
| 5,586,936 A | | 12/1996 | Bennett et al. | 463/25 |
| 5,605,334 A | * | 2/1997 | McCrea, Jr. | 273/309 |
| 5,613,912 A | | 3/1997 | Slater | 463/25 |
| 5,651,548 A | | 7/1997 | French et al. | 463/12 |
| 5,770,533 A | * | 6/1998 | Framcjo | 463/42 |

FOREIGN PATENT DOCUMENTS

| | | |
|---|---|---|
| CH | 573 635 | 3/1976 |
| DE | 3128094 | 2/1983 |
| DE | 3137484 A1 | 4/1983 |
| DE | 3403018 A1 | 8/1985 |
| DE | 3436827 A1 | 4/1986 |
| DE | 3515890 A1 | 11/1986 |
| DE | 3939450 A1 | 6/1991 |
| DE | 4328792 C1 | 12/1994 |
| DE | 4439502 C1 | 9/1995 |
| EP | 0310761 | 4/1989 |
| EP | 0416751 A2 | 3/1991 |
| EP | 0607823 A1 | 7/1994 |

OTHER PUBLICATIONS

Soviet Inventions Illustrated, Section E1, (Abstracts) week 8535, London: Derwent Publications Ltd., N85 162 294, T04, T05, SU 1140 137 A (Don Giprougleavtoma), Oct. 9, 1985.

* cited by examiner

*Primary Examiner*—Jessica Harrison
(74) *Attorney, Agent, or Firm*—Townsend and Townsend and Crew, LLP

(57) ABSTRACT

A method and apparatus for determining the win or loss of individual participants in a game of chance, such as for example Black Jack, Poker or the like, wherein the bet and the winnings are represented by chips. A central chip depository (102) is provided for receiving the game inventory and the latter has means for determining its momentary content. At least one chip deposit area (110, 111) is provided per participant and has in each case at least one sensor (701) for the detection of chips lying on the deposit area (110, 111). The means for determining the momentary chip content and also the sensors (701) have their outputs connected to the inputs of a data processing system (104).

11 Claims, 14 Drawing Sheets

APPARATUS AND METHOD FOR DATA GATHERING IN GAMES OF CHANCE

This application is a continuation of U.S. patent application Ser. No. 08/573,618, filed Dec. 15, 1995, now U.S. Pat. No. 5,919,090, the disclosure of which is incorporated by reference.

FIELD OF INVENTION

The invention relates to an apparatus and to a method for determining the turnover, the win and/or the loss of individual participants in a game of chance, such as for example Black Jack, Poker or the like, where the bet and the winnings are represented by gaming chips.

BACKGROUND OF INVENTION

Gaming chips is a generic term which covers tokens or "jetons" of all kinds, as well as coins, since casino games are sometimes played with coins rather than tokens. If coins are used as gaming chips, then they are valued at their face value. If tokens are used, then each token is associated with a certain monetary value. In American gaming casinos gaming chips are simply termed chips. In some American casinos it is also customary to use coins such as, for example, a silver dollar, half or quarter dollar coins (halves and quarters) or the like as chips.

In American gaming casinos in particular, it is important for the operator to know how much each of his guests has turned over (bet), won or lost during a day of gaming. It is generally customary for a player to be given privileges, such as for example a free meal, a free ride to the casino or home, or the like, depending on how much the casino theoretically or actually earns from the player.

DESCRIPTION OF THE PRIOR ART

An approximate determination of the turnover of the individual players took place hitherto by so-called pit bosses. These are employees of the casino who attempt to estimate the average bet of each player, the number of games per hour and also the time each player plays at the table, and thus the turnover, profit or loss of the individual casino visitors, through the observation of the progress of the gaming. Disadvantages of this method are the high costs of personnel and the inaccuracy of the determination of the turnover.

In order to avoid such disadvantages, there are essentially two different systems which are known.

The first comprises a video camera system which views the gaming table at a shallow angle, records the stack of chips bet by the individual players and supplies this information to a processing unit which then determines the value of the chip stacks bet by means of a corresponding recognition algorithm. The practical realization of this method gives rise to difficulties in the optical recognition of chips, in particular with offset stacks or with several bet stacks (split bet) or other irregular bets. The optical characteristics of the chips, such as the reflection characteristic of their surfaces, their color and their appearance in general, change as a result of their use. However, the recognition of the different chip types takes place precisely with reference to these features. Accordingly, a permanent, reliable operation cannot be achieved, or can only be achieved with substantial cost and complexity. Moreover, it can transpire that the recordings made by the camera system are influenced by unpredictable events, such as the lenses being obscured, change of brightness at the gaming table or the like, and the measurement result is thereby falsified.

The second system involves providing each gaming chip with a marking associated with the chip value, such as a radio-frequency identity code recognizable in, contact-free manner by an electronic route, and the provision of a corresponding sensor for each player beneath the token deposit area at which the respective bet is placed for each hand. The value of the stack of chips bet per hand can be determined with the aid of this sensor.

The disadvantage of this system lies in the fact that the chips required are complicated to manufacture and thus relatively expensive.

OBJECTS OF THE INVENTION

It is the object of the invention to avoid the disadvantages of the known systems and to set forth an apparatus with which the determination of the turnover, win or loss of individual players is possible in a reliable manner.

It is a further object of the invention to enable a dealer's performance to be assessed.

It is a yet further object of the invention to acquire the data required for assessing the players turnover and the dealer performance in a relatively simple and reliable manner which does not place an extreme burden on the dealer.

Further objects and advantages will become apparent from the following description.

SUMMARY OF THE INVENTION

According to a first aspect of the present invention, there is provided a method for determining the total amount bet by individual players participating in a plurality of hands of a game of chance, such as Black Jack, Poker or the like, at a gaming table having betting areas for each player on which the players place the gaming chips they wish to bet for each hand, with the cards being dealt by a dealer and with a gaming chip depository being provided at the gaming table, the method comprising the steps of:

detecting the start of each new hand, detecting whether or not each individual player has placed a bet in each respective hand by detecting the presence of at least one gaming chip representing the bet on the respective betting area associated with each individual player, detecting the total value of gaming chips present in said gaming chip depository, collecting the bets of individual players who have lost a hand, for example by exceeding a predetermined score, and placing the bets individually in the gaming chip depository, identifying the size of each bet placed in the gaming chip depository by determining the change in value of the gaming chip depository, associating the size of this bet with the respective betting area, and thus with the player, counting the total number of hands played by the player, and determining the total amount bet by that player by mathematically linking an average amount bet by the individual player determined for at least some of the hands he has lost with the total number of hands he has played.

According to a second aspect of the present invention, there is provided an apparatus for determining at least one of the amount bet, or the amount won or lost by individual participants in a game of chance, such as for example Black Jack, Poker or the like, wherein the amounts bet and won are represented by gaming chips, the apparatus comprising:

a central chip depository for receiving the game inventory, means for determining the momentary content of the central chip depository, at least one chip deposit area per participant, at least one sensor associated with each chip deposit area for the detection of one or more chips lying on this deposit area, and a data processing system to which said means for determining the momentary chip content and also said sensors are connected.

Through a method or an apparatus of this kind neither the progress of the gaming nor the gaming participants are disturbed, Additionally the apparatus is relatively simple, functions reliably and is durable.

In a further development of the invention, provision can be made for at least one deposit area to be provided per participant for the laying down of the chips that are being bet.

With the combination of this sensor and the central chip depository, it is possible to determine in a simple manner the bet of each player for each hand and/or game.

Additionally provision can also be made for at least one deposit area to be provided per participant for the laying-down of the chips that are won.

Through this simple extension it can always be clearly determined whether the particular player has won or lost in the actual hand of the game.

A preferred embodiment of the invention can consist of the chip deposit areas of each participant being combined into a participant unit.

A unit of this kind is clearly arranged and thus simple to handle.

Furthermore, provision can be made for a gaming status sensor to be provided which detects the start of each gaming hand and is connected to the input of the data processing system.

With the aid of a sensor of this kind, incorrect contact with the win sensor and/or the bet sensor can be ignored and the accuracy of the overall apparatus can be improved.

A further feature of the invention can be the provision of a table keyboard which is connected to the data processing system.

In this way the dealer can feed into the system information such as corrections, basic information, and changes in the chip content of the depository that are not dependent on the progress of the gaming or similar information.

A preferred embodiment of the invention can lie in the fact that the outputs of all sensors are connected to the inputs of the data processing system via a first interface and a second interface, and in that the table keyboard is connected to the data processing system via the second interface.

Through the use of such interfaces, it is possible, on the one hand, to reduce the wiring complexity and, on the other hand, the data processing system is assisted in the operation of the peripheral units (sensors, keyboard, token depository) whereby the speed of the calculating procedures is increased.

Furthermore, provision can be made for the sensors to be formed by force pick-ups, inductive or capacitive sensors, sender-receiver pairs, such as for example infrared, ultrasonic or laser transmitters/receivers, video pattern recognition systems or the like.

Such sensors operate in this connection particularly reliably because they are not influenced by use dependent changes of the chips such as the appearance of the tokens, the reflexion characteristics of the token surface or the like.

DETAILED DESCRIPTION OF THE PREFERRED EXEMPLARY EMBODIMENTS

Figure 1A:
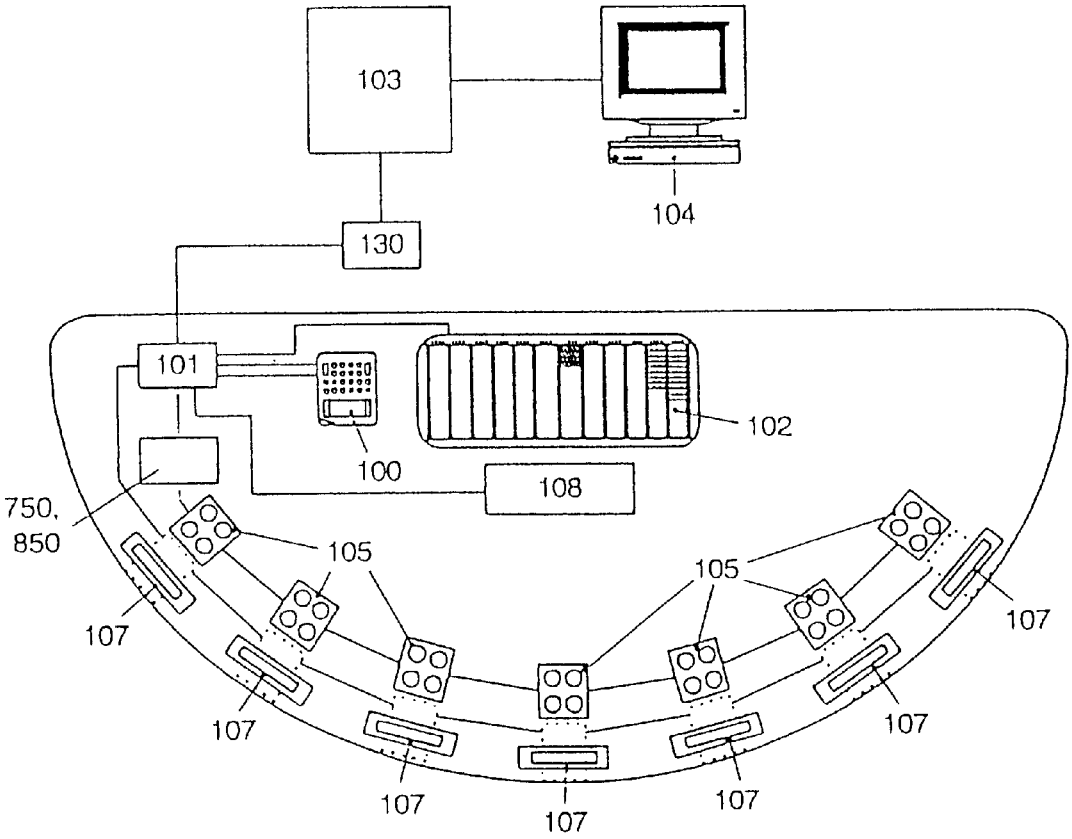
FIG. 1A illustrates an apparatus in accordance with the invention installed at a gaming table and shown schematically in plan view.
Figure 1B:
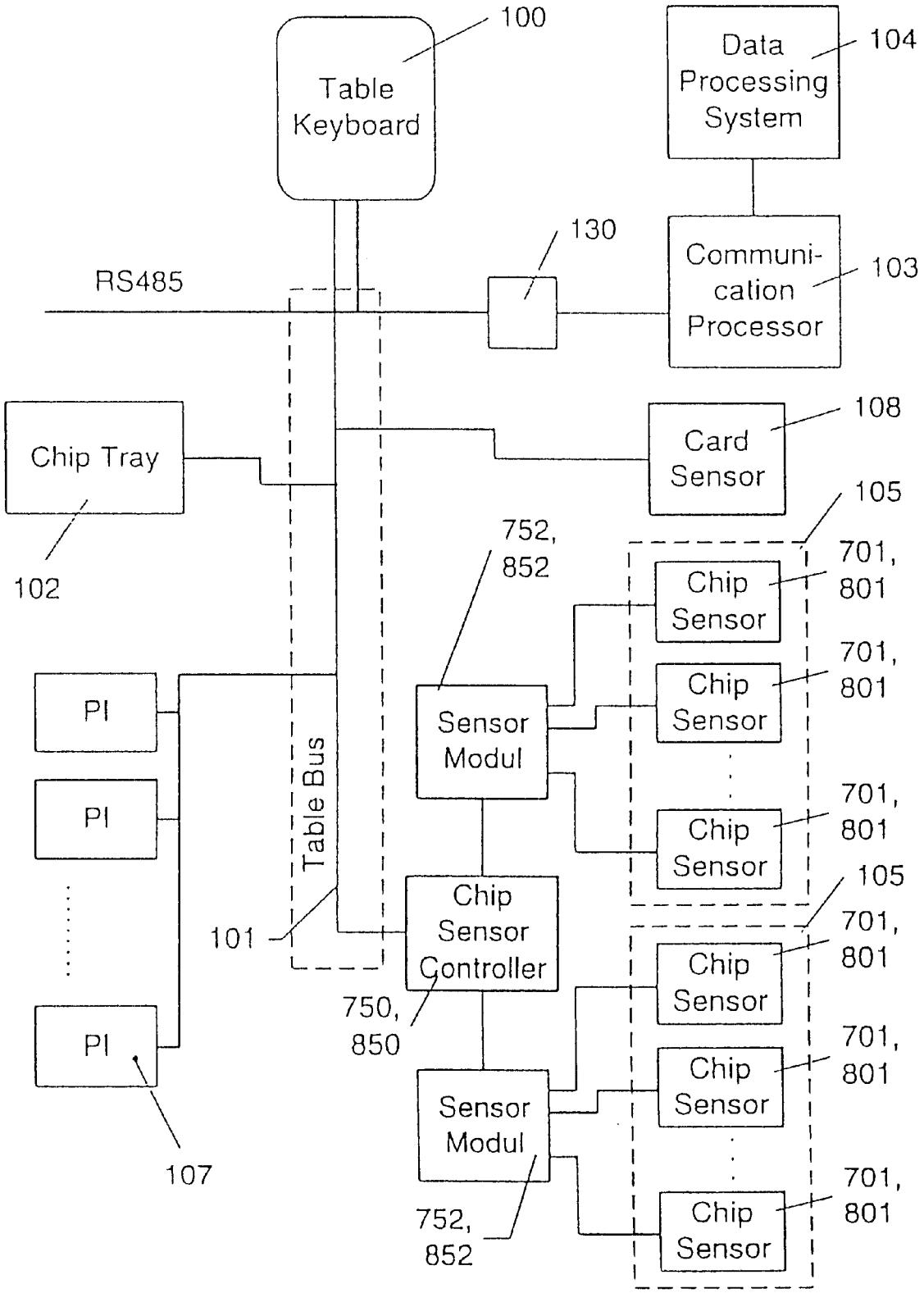
FIG. 1B is a schematic block circuit diagram of the apparatus of FIG. 1A.
Figure 2:
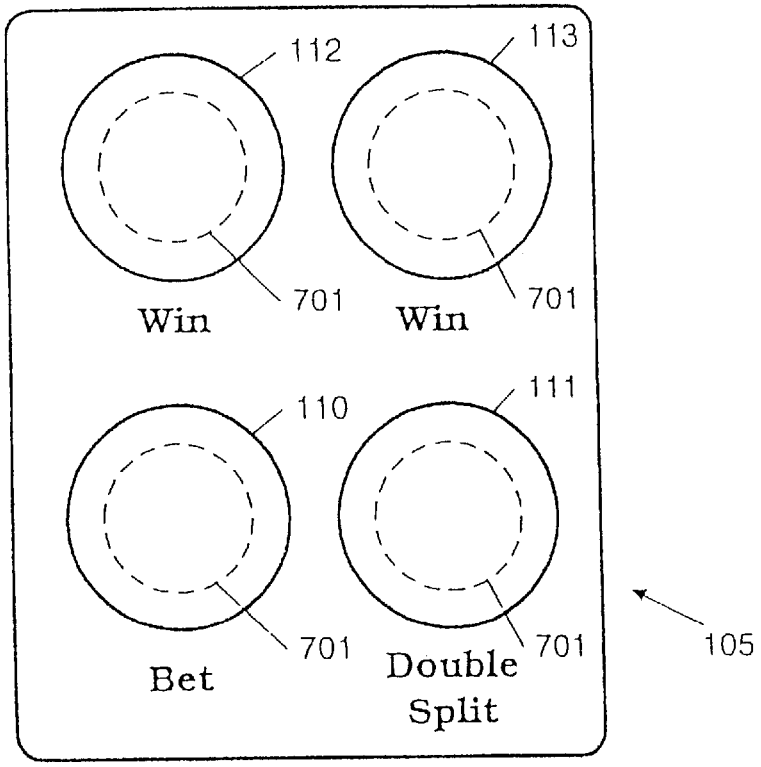
FIG. 2 illustrates an arrangement of a token deposit area in plan view.

A general explanation of the invention will be now given with respect to the game "Black Jack" and with reference to FIGS. 1A, 1B and 2. The object of the card game "Black Jack" is to-build up a hand of any number of cards with the sum of the individual card values lying as close as possible beneath 21 or being precisely equal to 21. The course of the game is such that at the start of each hand all participants specify their bets for the hand by placing this bet in the form of a stack of gaming chips in front of them. Thereafter the dealer (a casino employee who runs the game) deals each participant and himself two cards. If desired the participants can also each request further cards from the dealer. If the card score exceeds the value 21 on addition of a new card then the relevant player must uncover his whole hand, has lost his bet and leaves the game for the actual hand. If all the participants remaining in the game have sufficient cards then the dealer must, in accordance with the rules of the game, correspondingly take cards, and lay them open, i.e. so that they are visible for all participants. Then the cards of all the participants are uncovered by the dealer. Those participants whose card scores are greater than that of the dealer win and, the participants whose card scores are lower than that of the dealer lose their bet. The precise rules used for the game vary from state to state but follow the same general pattern. The specific rules applicable to the game as played in British Columbia are appended to this specification for ease of reference.

The determination of the turnover, win or loss of each participant in this game, takes place with an apparatus which, in accordance with the present teaching, essentially has a central token depository or a chip tray 102 having a means for determining its momentary content and the momentary content of at least one chip deposit area or betting square 105 per participant. Each betting square 105 has two deposit areas 110, 111 for bets placed by the associated players and two deposit areas 112, 113 for his winnings which are placed by the dealer on the respective areas. The betting area 111 can be used either in the case of a split bet or in the case of a doubled bet as explained in Sections c (iii) and c (iv) of the attached "Rules of Play in Casinos in British Columbia".

In addition, the betting area 111 may be used if a second player stands behind a seated player at the table and participates in the hand by betting with the player, who is responsible for calling for extra cards and actually playing the hand. The win area 113 is associated with the bet area 111. The deposit areas 110, 111, 112 and 113 each have at least one respective chip sensor 701 with the aid of which a determination can be made whether chips are present on the associated deposit areas 110, 111, 112 or 113. At least one deposit area 110 is provided for the laying down of the chips that are being bet.

Both the apparatus for determining the momentary content of the chip depository and also the sensors 701 have their outputs connected to the inputs of a data processing system 104, illustrated here as a computer. The data processing system 104 can be a stand-alone computer, such as a personal computer, or a terminal of a network of computers forming the data processing system.

The means for determining the instantaneous content of the chip depository delivers this content in a manner which can be processed by an electronic route, i.e. in the form of an electrical signal. A signal of this kind can, for example, be generated by electrical force pick-ups, electronic sensing means such as transmitter-receiver pairs (infrared transmitters/receivers or the like) and, by switches which can be actuated by the chips, or the like.

At the start of a gaming hand, all participants now place their-bets on their bet deposit areas 110. The participants can now call for extra cards if they feel their score is too low. If this leads to the player's score exceeding 21, i.e. the player overdraws, then the hand is immediately "bust" and is shown to the dealer, who immediately removes the player's bet from the deposit area 110 and orders it into the chip depository 102. The data processing system 104 can unambiguously determine the size of the bet of the participant by sensing the removal of the chips from the sensor 701 associated with the betting area and by the increase in the inventory of the chip depository 102 which occurs immediately thereafter.

The other players who may or may not have taken extra cards and whose scores do not exceed 21 then wait till the end of the hand to see what the dealer has scored. Those with lower scores have lost, those with higher scores have won, and those with equal scores have neither won nor lost. Towards the end of the hand the bets of all participants who have lost are removed and the corresponding sensors 701 are thereby relieved, i.e. their output signals change from "chip present" to "chip absent". For the winners, the bet remains on the deposit area 110 and thus the corresponding sensors 701 are not relieved. In this way the data processing system (104) can uniquely determine who of the participants has won and who has lost. The precise sum won or lost is however not known because at this stage of the hand the dealer generally pulls in the bets from all the losers together, pays the winners from these takings and either orders the remaining difference in the chip depository 102 or takes further chips from it if necessary to pay the winners. Thus there is no clear association between individual players and the amount bet or won at this stage of the hand. Since it can however be assumed that each player always makes substantially the same bet for each hand, this average can form the basis of the calculation.

The establishment of this average value takes place by average value formation of the precisely detected bet in those hands in which the participant overdraws.

In the embodiment of the invention shown in the drawing, at least one deposit area 112 is provided for each participant and serves for the laying down of the chips that are won. At the end of each hand the dealer places the stack of chips won by the respective participant on deposit area 112 for the winnings. Accordingly, independently of the state of switching of the bet sensor 701 for the deposit area 110, a clear classification of the individual participant as a winner or loser can take place.

A faulty calculation could however take place if the winnings deposit area 112 of a participant is incorrectly loaded during the gaming (the participant drops one of his cards, contacts the deposit area with his hand, or a chip falls on it unintentionally). Through an event of this kind, the data processing system 104 will incorrectly book a win for the corresponding participant.

In order to determine the number of hands per unit time, a so-called gaming status sensor 108 is provided, which is preferably realized as a card sensor for the dealer cards. It could, however, be realized differently, e.g. as a simple push button actuated by the dealer at the start of each hand. In the case of Black Jack, this sensor essentially delivers a blocking signal as long as cards are being dealt and this blocking signal serves to distinguish the gaming states "hand being played" and "end of hand".

Furthermore, the data processing system 104 is caused to evaluate only the relieving of the bet deposit areas with a subsequent increase of the content of the chip depository (i.e. the player has overdrawn), but to ignore all other sensor actuations so that the above-mentioned faulty conclusions can also be avoided.

By the end of a hand all the participants remaining in the game have enough cards. The payment of the winnings or the collection of the bet takes place, the game status sensor 108 delivers a release signal to the data processing system 104. The latter senses changes of the output singals of the sensors 701 of the bet areas 110 (and optionally 111) and of the win areas 112 representing the placement of chips on the win areas 112 (and optionally 113) and the removal of chips from the bet areas 110. Thus loading of the win area sensors 701 and also relieving of the bet area sensors 701 which occur without the content of the chip depository being subsequently increased are evaluated.

When observing a Black Jack gaming table, it is particularly advantageous to realize the game status sensor 108 as a card sensor located beneath the dealer card deposit area since the dealer cards are placed precisely in accordance with the above-described gaming states. When the dealer deals cards to himself they are laid on the deposit area associated with the card sensor. On the taking of further cards by the dealer, these likewise cover the card sensor and first free the card sensor when all cards have been removed therefrom. It will be appreciated that the arrangement of two bet areas 110, 111 and of two winning areas 112, 113 for each participant can be regarded as a betting square 105, i.e. the chip deposit areas 110, 111, 112 and 113 in FIG. 2 are combined into a participant or player unit 105.

Furthermore, a table keyboard 100 connected to the data processing system can be provided.

This serves to determine non game dependent filling changes of the chip depository 102. Such changes are, for example, drops (dealer sells chips to a player), markers (dealer, pit boss or inspector grants credit in the form of chips to a player), fills or credits (transfers of chips from the chip depository 102 to the casino chip bank or from the casino chip bank into the chip depository 102) or the like.

The table keyboard 100 can replace the described gaming status sensor 108 inasmuch as the dealer can advise the data processing system 104 of the start of a new hand, e.g. by inputting his card score.

Regarding to the way the apparatus of the invention was previously described, it is only possible to determine the turnover result for the individual participant or player unit 105. If this turnover result is now to be associated with the individual guests, then it is necessary to advise the data processing system 104 as to which guest has played at which participant unit 105 during which time interval.

This association can take place in several ways. For example, each casino guest can have an electronically readable identity card which he hands to the dealer who introduces the card into a reading apparatus built into the table keyboard 100 and thereby advises the data processing system 104 of the identity of the new player. The position of the player unit 105 used by the new player is also fed in manually. If the player has purchased chips from the dealer then the value of the chips he has purchased can be communicated to the data processing system by a manual input at the keyboard 100.

If the casino is not equipped with the identity cards then the inputting of the player's identity can also take place by a manual input.

Through the inputs, the time at which a new player starts playing is also determined, and the end of play of a player is announced to the data processing system 104 by manual input.

If all the tables of the casino are equipped with such monitoring apparatus and connected to a central data processing system 104, then the turnover result for each guest can be relatively accurately calculated therewith.

An improvement of the association of the guests to the player units 105 that are used can also take place in such a way that each guest receives an electronically readable identity card and a read unit 107 is associated with each player unit 105. If a guest starts to play at any player unit 105, he first registers himself by means of his identity card. In this way the data processing system 104 evaluates the game at the previously used player unit 105 as terminated and the game at the same unit 105 as having just started.

A provision is made with casino games that guests do not have to participate directly in the progress of the game, but can instead observe a player and can assist the latter with their additional bets which can be placed on the betting area 111. For such players, no separate reading apparatus must be provided, they are covered, in precisely the same way as guests who do not have an identity card, by manual input.

In the preferred layout of the circuitry shown in FIG. 1*a* the chip sensors 701 of each participant unit 105 are connected via sensor modules 752 (FIG. 5) to a sensor module controller 750 (FIG. 6) and the latter is connected to an interface bus 101.

The card sensor 108 is also connected via circuits similar to 752 and 750 to the interface 101. In addition, the player identification units 107 and the means for measuring the momentary content of the chip tray 102 are connected to the interface 101. This interface 101 is conveniently realized as a multi-plug interface where the individual terminals of the individual plugs are connected together to define a table bus.

The table keyboard 100 and a further interface module 130 are also connected to the interface 101.

Between the second interface module 130 and the data processing plant 104 there is arranged a so-called communication processor 103 which serves to adapt the signal shape delivered by the interface 101 to the signal shape which can be processed by the data processing system 104. This can however also be omitted when the output signals of the interface distributor 101 can be directly read by the data processing system 104.

The mentioned sensors 701 can be formed by any desired devices which can detect objects. Since These devices now only need to recognize whether an article is present or not, their output signals are thus of a binary nature (article present or no article present). Some examples for these devices are force pick-ups, inductive or capacitive sensors, sender-transmitter pairs such as infrared, ultrasonic, laser transmitters/receivers, video pattern recognition systems or the like.

The invention has hitherto been described with reference to the game "Black Jack". This is, however, not to be regarded as a restriction because the apparatus of the invention can also be used for determining the player profit of other casino table games. Under some circumstances it can be necessary to position one other of the sensors differently or to make additional inputs via the table keyboard. The basic idea for determining the average bet of each player however remains the same.

DETAILED DESCRIPTION OF THE METHOD OF OPERATION

Figure 3A:
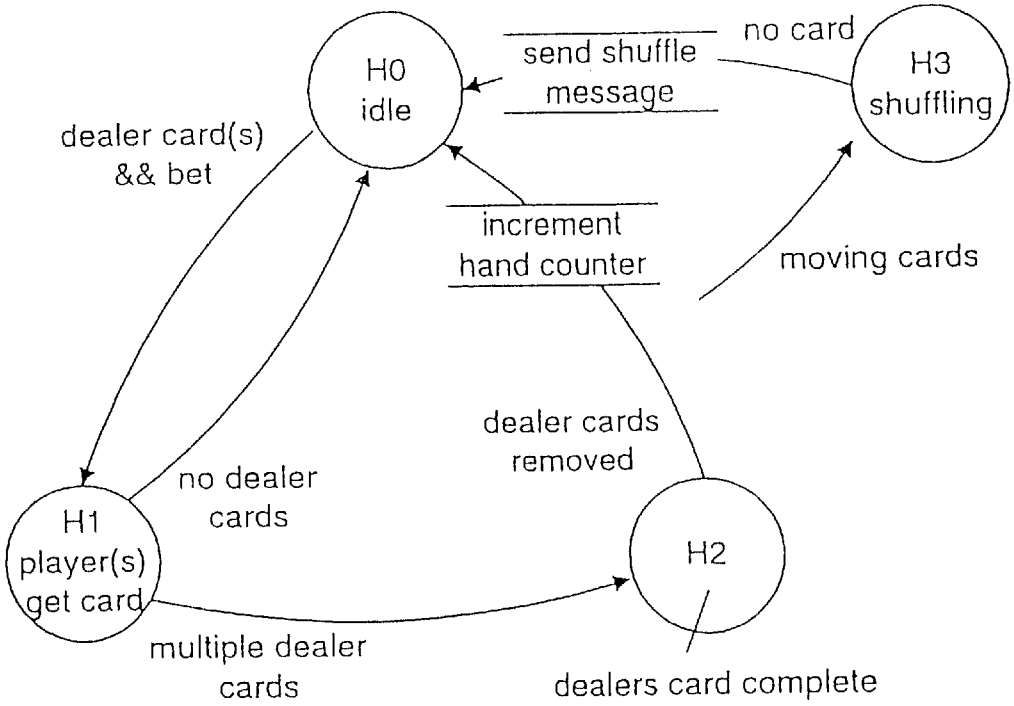
FIG. 3A is a flow diagram showing the status of play during the playing of a hand with reference to the game.

FIG. 3A shows the various states of a hand to explain how these states are recognized by the data processing system.

The circle labelled HO idle represents the situation before a game is played. This is the situation which prevails when the casino opens, the state which prevails at the beginning of each hand of cards, and the state which prevails when the dealer is changed. In all three cases there will be a certain inventory present in the chip tray 102 which is precisely known to the data processing system 104. As will be described later, sensors are associated with the chip tray 102 which monitor the contents of the chip tray and send appropriate information to the data processing system 104.

Before the start of the first game of the day and at intervals throughout a day's gaming, it is necessary for the dealer to shuffle the cards, which is either done manually or by machine. In any event, it is usual for a predetermined number of packs of cards, usually at least four and normally five, to be shuffled together. Thereafter the dealer hands a plastic separator to one of the players who is asked to insert it approximately at the middle of the stack of shuffled cards. The shuffled cards are then placed on the gaming table face down near to the dealer and the dealer normally deals only cards from the top-half of the shuffled stack of cards, i.e. from the cards above the plastic separator. He may however use cards immediately beneath the separator if this is necessary to complete a particular hand. Once the separator is reached the cards are reshuffled as soon as the hand which is being played has been completed.

Before the start of each hand, each player is called upon to place his bet and does so by placing the gaming chips he wishes to bet for the next hand on the betting square 105 in front of him, and indeed with the chips being positioned over the betting area 110 in FIG. 2. The player can choose the value of the chips he wishes to bet for any particular hand up to the maximum value permitted for the table. As soon as the players have placed their bets, the sensors 701 associated with the betting area 110 of each betting square generate a signal showing whether or not a bet is present. The value of the bet is, however, not determined, that is to say, the sensors 701 are only called upon to give a YES/NO signal depending on whether or not a bet has been placed by a particular player. The presence of bets is a first signal to the data processing system 104 that a game is about to start.

The dealer then proceeds to deal one card to himself and two cards to each of the players. In some jurisdictions the rules provide for the players to receive the cards first while in other jurisdictions the dealer receives the first card and then deals further cards to the players.

The dealer lays his card on a specified portion of the table and this part of the table has a card sensor 108 which will be described later with respect to FIG. 7. The card sensor makes it possible to distinguish between a single card and two cards lying alongside one another or partially overlapping. Once the dealer has dealt himself a single card and placed this face up on the appropriate field of the table, the card sensor 108 generates a signal recognizing this card and this signal, in conjunction with signals from the sensors 701 of the betting squares 105 of players who have placed bets indicating to the data processing system that a hand is about to start. The hand has now reached the hand state H1 and each player is able to look at his cards and decides whether or not he will risk taking another card.

It is possible that a hand once started has to be terminated prematurely due to some irregularity. In this case the dealer removes his card or cards from the card sensor 108 which gives a signal corresponding to "no dealer cards" and the hand returns to the state H0. No increment of the hand counter is effected in the data processing system, since the hand was aborted. However, the time lost is noted and is relevant to an assessment of the dealer's performance. It will be noted that the dealer may also have dealt himself two cards and placed them one directly above the other on the card sensor (which then reacts as if only one card were present). The second card would then be placed face down. However, the dealer would generally check his hand for Black Jack should the face-up card be an Ace or a Jack. This is done with a mirror or some other recognition means. If the dealer has Black Jack he will fan out his cards face up and will do the same with the cards of all players. All bets are collected by the dealer with the exception of a "push" situation when a player has Black Jack. This player's bet remains.

If all players are satisfied with the cards they have received, and do not wish to take any more cards, then they indicate this to the dealer who then either deals himself a second card and lays it on his card field overlapping or adjacent to the first card, or turns his top card over and places it next to or overlapping his first card. The presence of two cards on this card field is recognized by the dealer card sensor 108 (which will later be described in more detail with reference to FIG. 7) and a corresponding signal is sent to the electronic data processing system which knows that the hand has now proceeded to the state H2. This change of state is indicated by the arrowed line "multiple dealer cards" in FIG. 3*a*. If no player has taken any further cards then no player can have a card score higher than 21. A comparison is now made between the card score achieved by the dealer and the card score achieved by each individual player. Players who have lower card scores than the dealer have lost their bet and their bets are taken by the dealer. The dealer then pays all players who have won by placing the chips won on their win areas 112. If extra chips are necessary they are taken from the chip tray, alternatively the balance of chips that remains is added to the chip tray.

The cards are then removed from the table including the dealer cards and are then placed in the discard rack. The change in signals from the betting area sensors 701 of the players who have lost, the change in signals from the winning area sensors 701 of the players who have won and the change in signals from the card sensor 108 indicate to the data processing system 104 that the hand is now complete and the system has returned to the state H0 idle, i.e. a new hand is about to commence. No information has as yet been gained from the last played hands since no player "busted" by taking extra cards. However, the hand counter has been advanced by one. This hand counter is actually an entry in the data processing system rather than a physical counter or display (although the hand count could be displayed if desired). In addition the changes in signal at the players' betting square sensors 701 show if an individual player has won, has lost, or has neither won nor lost (no change in sensor signals from his betting square 105).

As an alternative to the relatively rare situation described above, where all players take no extra cards, some or all players may elect in hand state H1 to take one or more extra cards in an attempt to achieve a score closer to 21 and in the hope that they do not exceed a card score of 21. Players continue to ask for cards until they are satisfied with their score. Players whose score exceeds 21 as a result of being given extra cards have lost their bets, i.e. have "busted", and these bets are immediately collected by the dealer for each player in turn, with the chips being added to the chip tray 102. A first signal is generated when the chips are removed from the betting field 110 of the player's betting square 105, as sensed by the chip sensor 111, and the change in value which follows at the chip tray 102 is noted by the data processing system 104 and provides precise information on the amount bet by the individual player.

Once all remaining players have sufficient cards, the dealer either deals himself a second card or turns over the second card he has already dealt himself and places it adjacent to or overlapping the first card. The two cards are then recognized by the card sensor which allows the data processing system to recognize that the game state H2 has been reached. Changes in chip tray inventory are no longer associated with an individual player for the remainder of this hand. A comparison is then made as before between the score achieved by the dealer and the scores of the players remaining in the game. Again the bets of players who have lost are collected and players who have won are paid out by the dealer who places the chips they have won on their win area 112. At this stage of the game there is no clear association of the amount bet or won by a particular player. However, the data processing system can recognize from the signals whether a player has won or lost or neither won nor lost. The changes in signals at the sensors 701 and the removal of the dealer cards again signal to the data processing system that the hand has been completed and causes it to increment the hand count by one.

Because the data processing system knows from each hand lost by a particular player how much that player has bet, it can work out an average bet per hand for that player and, knowing the total number of hands played and won or lost, or neither won nor lost by that player, can work out just how much a player has bet during his period at the table and how much he has won or lost in total. Indeed, this determination can be made with a relatively high statistical accuracy.

Figure 3B:
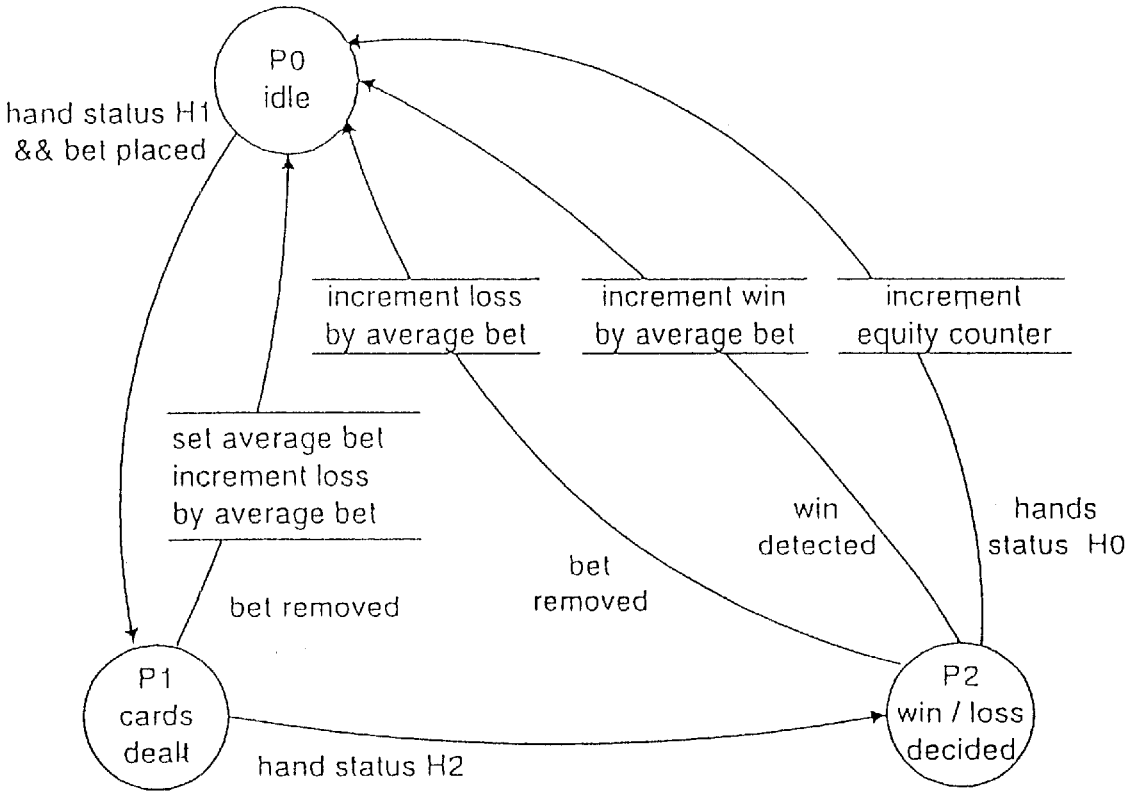
FIG. 3B is a flow diagram showing the status of play during the playing of a hand with reference to the player.

FIG. 3B shows a flow diagram similar to that of FIG. 3A but showing the situation from the player's point of view, i.e. showing the player states. P0 shows the initial situation before a hand starts. The player then places his bet on the betting area 110 of his betting square 105 which is sensed by the respective chip sensor 701. The cards are then dealt by the dealer and the card sensor 108 associated with the dealer senses when he has dealt himself a first card. This signifies that the players have also received their first two cards and the player has reached the player state Pi. Each player can then ask for further cards and stops playing when his score has reached a value equal to or just below 21 which is acceptable to him. In this case he has progressed to player state P2. If however his card score exceeds 21 he loses the hand in the player state P1. In this case, the bet is-collected by the dealer as described above and placed in the chip tray 102. The removal of the bet by the dealer is signalled by a change in the signal of the chip sensor 701 associated with the betting area 110 of the betting square 105 of the player. The increase in value of the chip tray 102 is established via the chip tray sensors. In this way, as described above, the data processing system knows the amount bet by that player for that hand.

If the player has proceeded to player state P2, i.e. has not overdrawn, then a comparison is made between his card score and that of the dealer and a decision can then be made whether the player has won or lost or neither won nor lost as described above. If he has lost, his chips are collected by the dealer (together with the chips of all the other players who have lost) and the winners are paid their winnings. The dealer pays the winnings from the chips collected from losers and either puts any balance in the chip tray or removes any extra chips required from the chip tray precisely as described earlier. Again there is no determination of the amount actually won or lost by each player at this state but there is a clear information as to whether a player has won or lost, or neither won nor lost. This information can be combined with information on the average amount he has bet to determine statistically over a plurality of hands how much each player has bet in total and how much he has won or lost.

The subdivision of each hand into hand states and player states makes it easier for the data processing system to make a clear association between signals received from the various sensors and changes in inventory at the chip tray. Since all changes noted by the data processing system occur at specific times related to the internal clock of the data processing system, it is possible for the software which evaluates the changes in sensor signals and changes in inventory at the chip tray to clearly relate these to the progress of the gaming and the individual hands, so that the desired information relating both to the players and, if desired, to the dealer can be put together and printed out. The individual items of the apparatus will now be described in detail.

Gaming Chip Sensors

Figure 4:
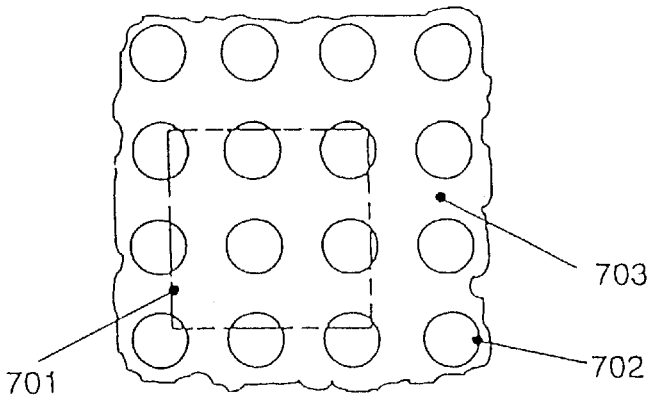
FIG. 4 is a schematic illustration of a chip sensor.

A first possible design for a gaming chip sensor is schematically illustrated in FIG. 4 and can be used as either the chip sensor 701 for either of the betting areas 110, 111 (bet and double-split areas) of the betting square 105, or as the chip sensor 701 for either of the two winning areas 112, 113 of the betting square 105 of FIG. 2. Since the sensor in the form of the photoelement 701 is located beneath the cloth 703 of the gaming table, it is necessary for the cloth to have apertures 702 at the betting and winning areas 110, 111 and 112, 113 and these apertures are provided in the form of a grid of smaller apertures 702. The diameter and grid spacing of the apertures 702 must be adequately small relative to the dimensions of the active surface of the sensor so that the size of the illuminated surface of the photoelement 701 does not change substantially if the position of the cloth 703 should shift slightly. The illumination of the room, or daylight, serves as the light source. If a gaming chip is placed on one of the areas 110, 111 or 112, 113, then the photoelement 701 is shaded and the output signal of the photoelement drops accordingly. This output signal of the photoelement is monitored by the electronic evaluation circuit and thus the shading of the element by a gaming chip is recognized by the electronic evaluation circuit and interpreted as a bet having been placed on the relevant field 110 or 111 as the player's winnings having been placed on one or both of the fields 112, 113.

As a result of this arrangement, four sensors are thus combined together to one module (player or participant unit) for each of the betting squares 105 shown in FIG. 2. It is of course possible to provide more than one photoelement for each of the areas 110, 111 or 112 or 113.

Figure 5:
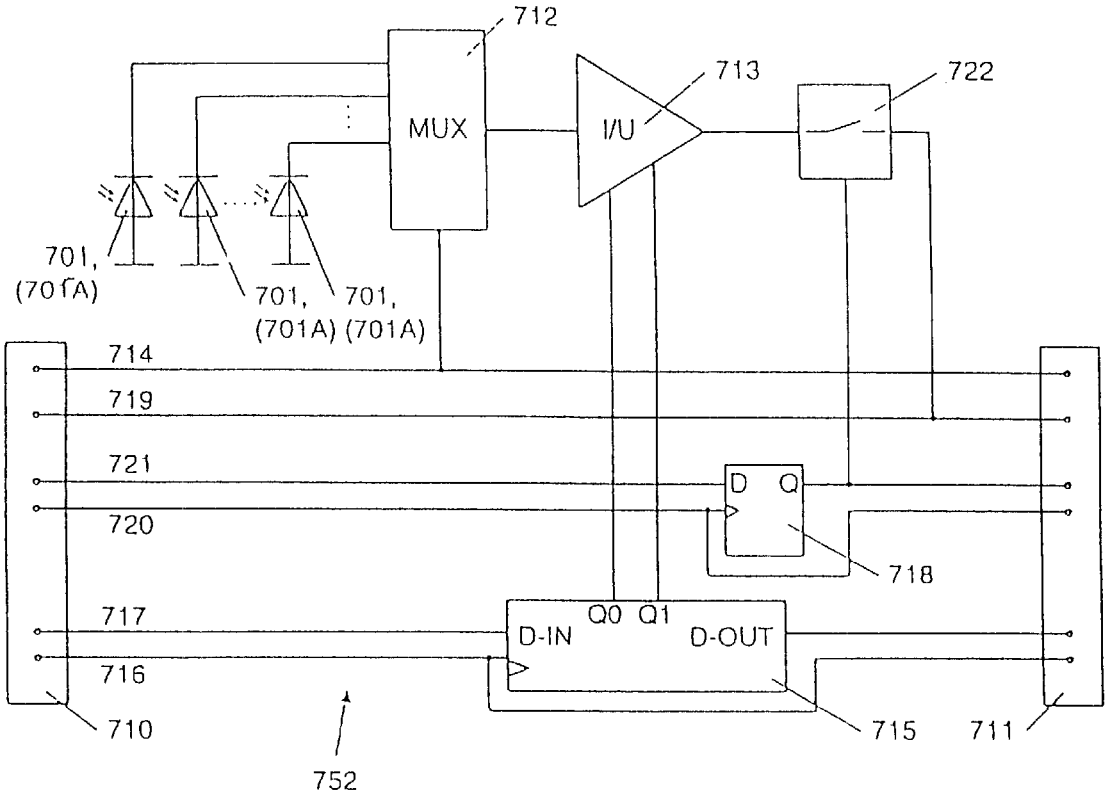
FIG. 5 is a block circuit diagram of a sensor module for reading out signals from a plurality of chip sensors of the kind shown in FIG. 4 or signals from a card sensor as illustrated in FIG. 7.

FIG. 5 shows how the sensors 701 of FIG. 4 are connected together to form a sensor module. Thus, in accordance with FIG. 5, a plurality of sensors, typically four sensors, are combined together to form a sensor module 752 in accordance with the arrangement of the sensors 701 on the table, at each betting square 105. Each module has a signal input 710 and a signal output 711. The modules 752 associated with sequential betting squares 105 can be cascaded together by simply connecting them in series. The first module 752 is connected to a controller 750 as schematically illustrated in FIG. 6, and the further modules 752 are connected in series with the first module.

The controller 750 selects and interrogates each photoelement 701 in turn via the address lines 714 (of which only one is shown in FIG. 5). In this way, each photoreceiver 701 can have a clear address so that the data processing system 104 can clearly distinguish which sensor 701 is associated with each element of each betting square 105. The signal of the addressed photoelement 701 is connected via an analog multiplexer 712 to a transimpedence amplifier 713, the amplification factor of which can be varied in several stages over a wide range. This amplifier is necessary because, under normal operating conditions, the strength of the output signal from the individual photoelements 701 can vary greatly within a wide range. However, signals of approximately the same amplitude are required for further processing.

Figure 6:
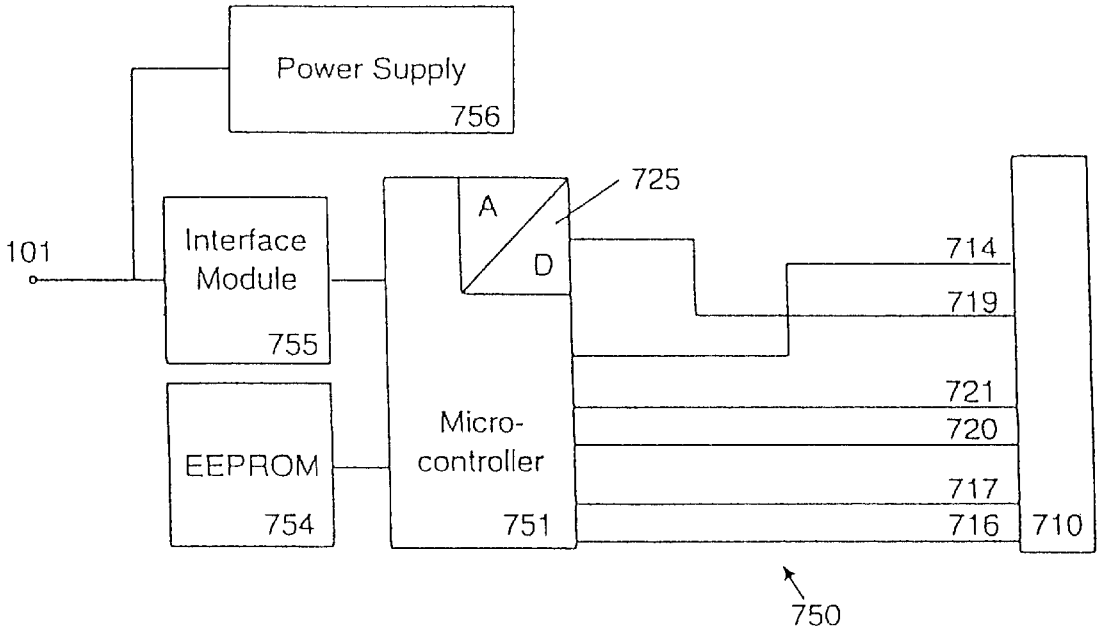
FIG. 6 is a block circuit diagram of a controller for a plurality of sensor modules as shown in FIG. 5.

Accordingly, the signal strengths of each photoelement are measured at the start of operation (in a calibration procedure) and are stored in the EEPROM of box 754 of the controller 750 of FIG. 6. The changing of the amplification of the preamplifier 713 to compensate for the differing normal signal strengths of the individual photoelements 701 is effected via the shift register 715 which is fed by the controller of FIG. 6 via a clock line 716 and a data line 717. When several modules are connected in series, the shift registers are cascaded. Accordingly, the amplification for each module can be set independently of the other. The flipflops 718 of the modules connected in series likewise form a shift register and serve to activate the switches 722 to switch through the amplifier output to the analog line 719 of the controller which is common to all modules. With the aid of the clock lines 720 and the data lines 721, the controller feeds a single one bit through the whole chain and can thus interrogate all modules one after the other.

The controller 750 consists of a microcontroller 751 with an integrated analog/digital converter 725. The microcontroller 750 generates the controlled signals for the sensor modules 752 as shown in FIG. 5 and evaluates the analog signals returned by the sensor modules 752. The data picked up is transferred via a serial interface 755 to the data processing system 104 via the table bus 101. The EEPROM 754 serves for the non-volatile storage of configuration and calibration data, including the calibration signals associated with the individual photoelements 701 of the attached modules 752. The interface can be adapted by the use of an exchangeable interface module 755 to permit adaption to various standards, for example RS232, RS485. The power supply module 756 provides the stabilized supply voltages required for the full apparatus.

The individual gaming chip sensors are interrogated according to the following scheme. The controller 750 selects, with the aid of the address line 714 for each of the attached modules jointly, one photoelement 701. The amplification information stored in the EEPROM 754 for the selected photoelements are then clocked into the respective shift register 715 of the respective module 752. The analog values generated by the respective photoelement 701 can then be examined. For this purpose, the controller sends a single "one" bit as a release signal through the shift register formed by the flipflops 718 and measures the voltage values that are returned. In order to reduce the influence of "flickering" light sources (for example gas discharge lamps operated at the mains frequency), this process is repeated many times and the average value for each sensor is formed from the measured values. Thereafter, a new address is selected with the lines 714 and the procedure is repeated.

Figure 8:
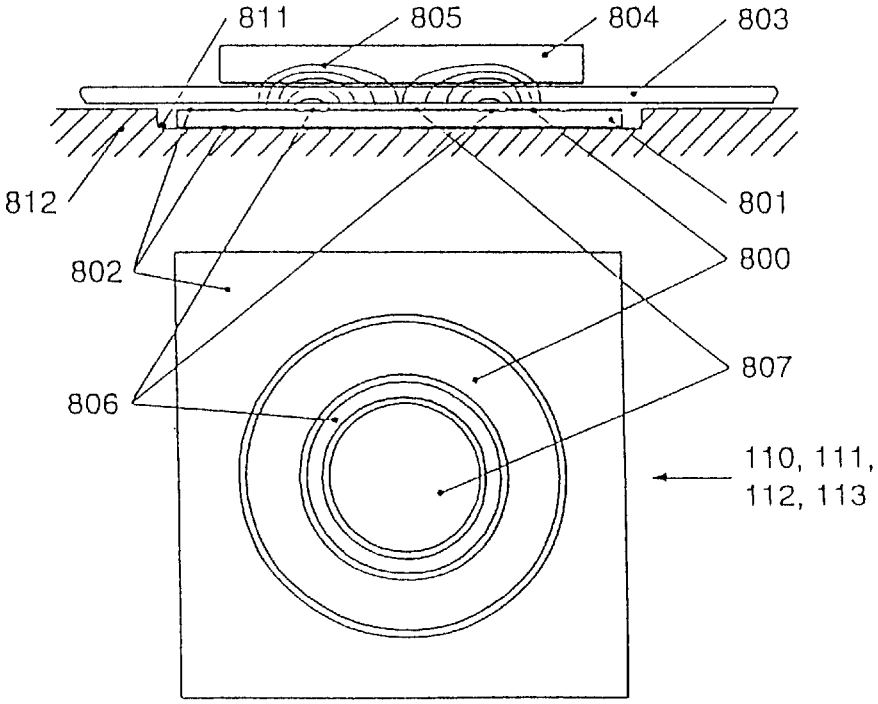
FIG. 8 is a schematic illustration of the preferred chip sensor of the present invention.

An alternative gaming chip sensor in the form of a capacitive sensor is shown in FIG. 8 and represents the best embodiment known to the applicants. FIG. 8 is in fact a composite view with the lower half showing a plan view of the sensor 801 as embodied in both the bet areas 110, 111 and in both the win areas 112, 113 of FIG. 2, whereas the top half of the drawing shows a section through the gaming table with a chip present on the sensor which is typically let into a recess 811 in the gaming table 812. The capacitive sensors described here as gaming chip sensors have the advantage that they can operate through the cloth 803 covering the gaming table without this cloth having to be apertured or cut away. Moreover, they enable a design in which, for example, cards placed over the sensors do not influence the sensors, but which do enable the sensors to be made sensitive to a variety of gaming chips, be it plastic gaming chips, or metal gaming chips, or coins which are used as gaming chips.

Figure 9:
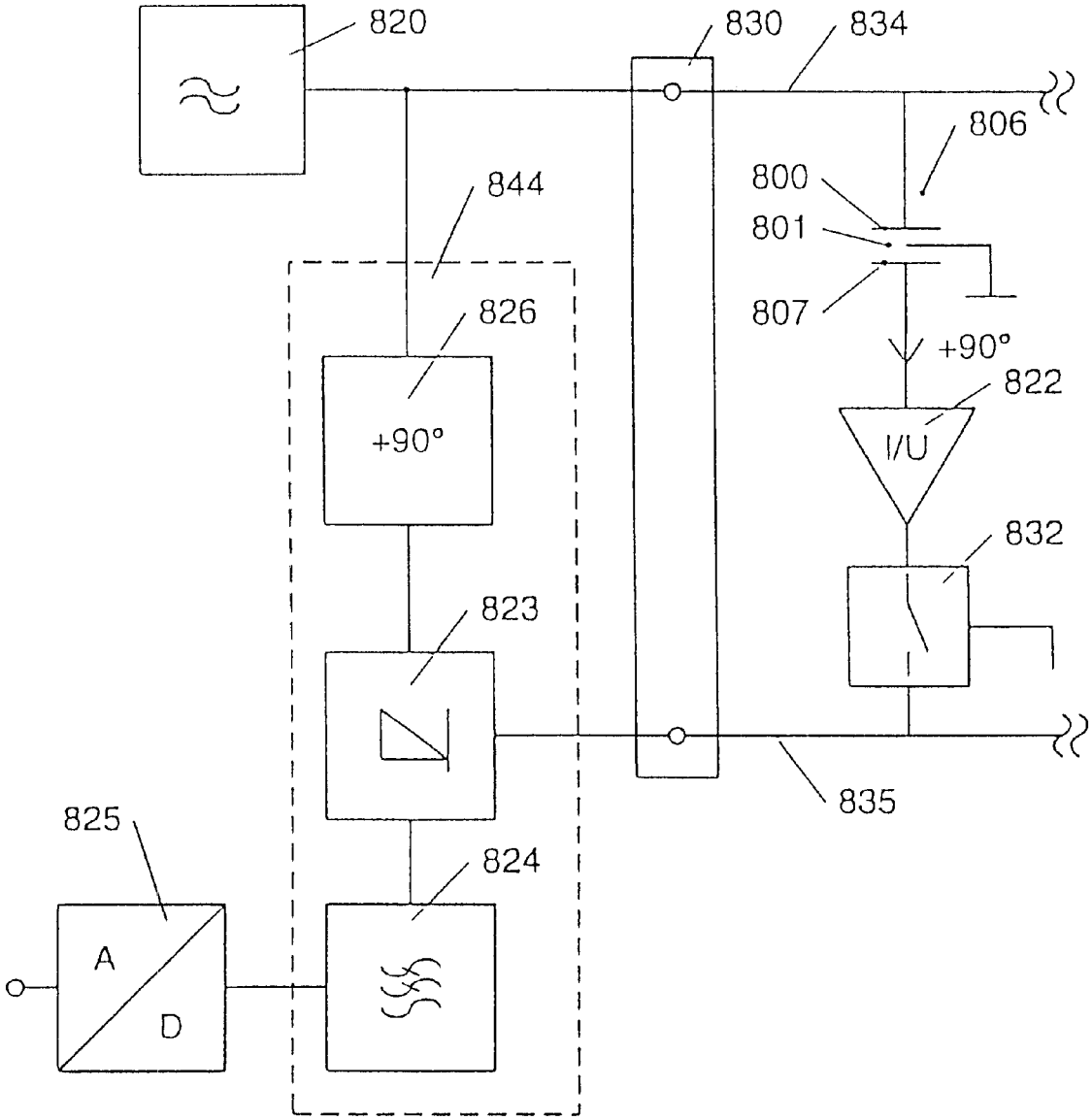
FIG. 9 is a block circuit diagram of a power supply for use with the chip sensor of FIG. 8.

As seen in FIG. 8, the sensors 801 are executed as double-sided copper-coated printed circuit boards 801 and consist of an annular generator electrode 800 and of a circular pick-up electrode 807. A screening ring 806 is present between these electrodes which is connected, in the same way as the rear side and the surrounding surface of the printed board 802, to earth potential. If an alternating potential is now applied to the generator electrode 800, then an alternating electrical field forms between this electrode 800 and the pick-up electrode 807. The part of the field between the generator and pick-up electrodes relevant for the operation is indicated by the field lines 805. If a plastic chip 804 that has a dielectric constant that is a multiple of the dielectric constant of the air, is placed on the cloth 803 above the sensor 801, then the coupling capacity between the two electrodes 800, 807, and thus also the current which can be picked up at the pick-up electrode 807, is increased. The screening 806 reduces the direct coupling between the two electrodes 800, 807 which cannot be influenced by the chip 804. The same situation arises if a metal chip or coin is used instead of the plastic chip 804. The shape of the field lines is however different in that they will extend generally perpendicular to the chip 804, The measurement arrangement required to detect the capacity change is illustrated in the block circuit diagram of FIG. 9. The sensor 801 is fed from a sinusoidal oscillator 820. The sensor current, which has a phase shift of +90° relative to the oscillator output voltage, is amplified in a transimpedance amplifier 822 (a current/voltage converter). A synchronous demodulator consisting of a mixer 823 and a low-pass filter 824 is used for rectification in order to increase the noise-to-signal ratio. In order to compensate for the phase shift through the sensor, the reference signal applied to the mixer 823 has to be likewise displaced through 90° with the aid of a phase shifter 826. The output signal of the synchronous demodulator can be quantized into a digital signal for further processing with the aid of an analog-to-digital converter.

Figure 10:
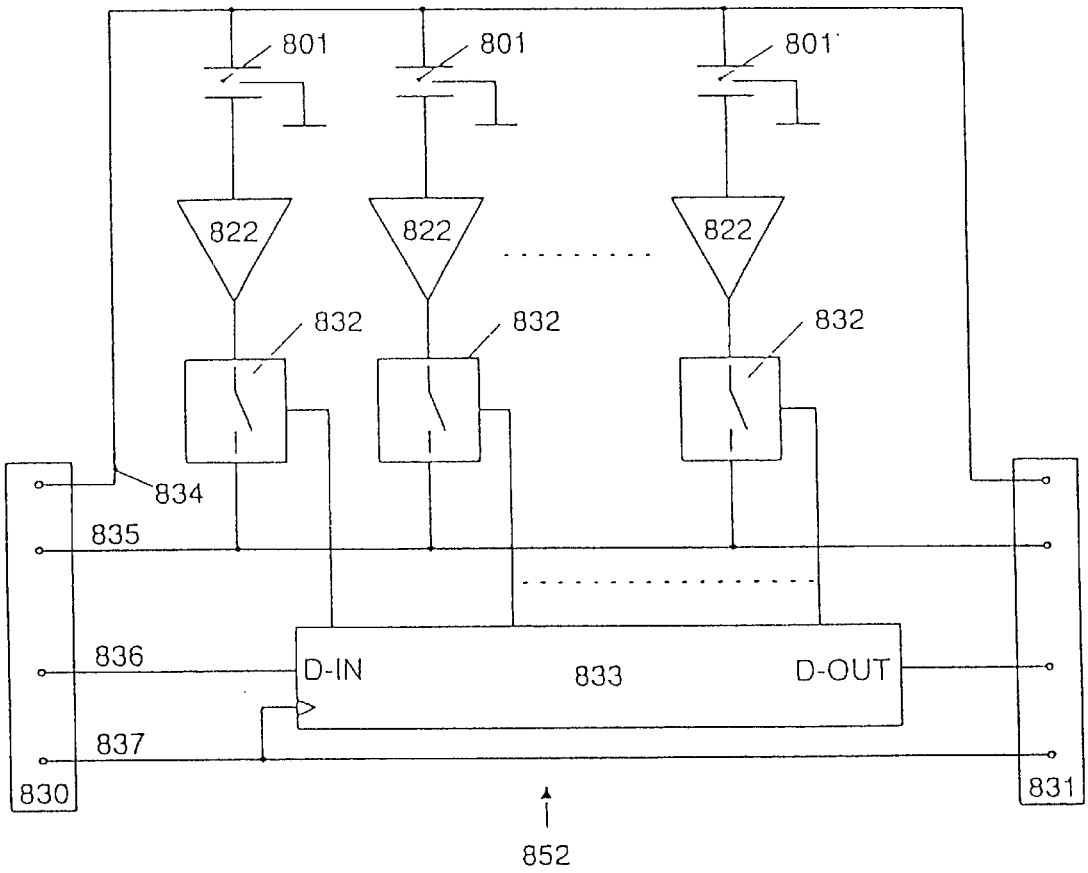
FIG. 10 is a block circuit diagram similar to that of FIG. 5 but for use with the chip sensor of FIG. 8.
Figure 11:
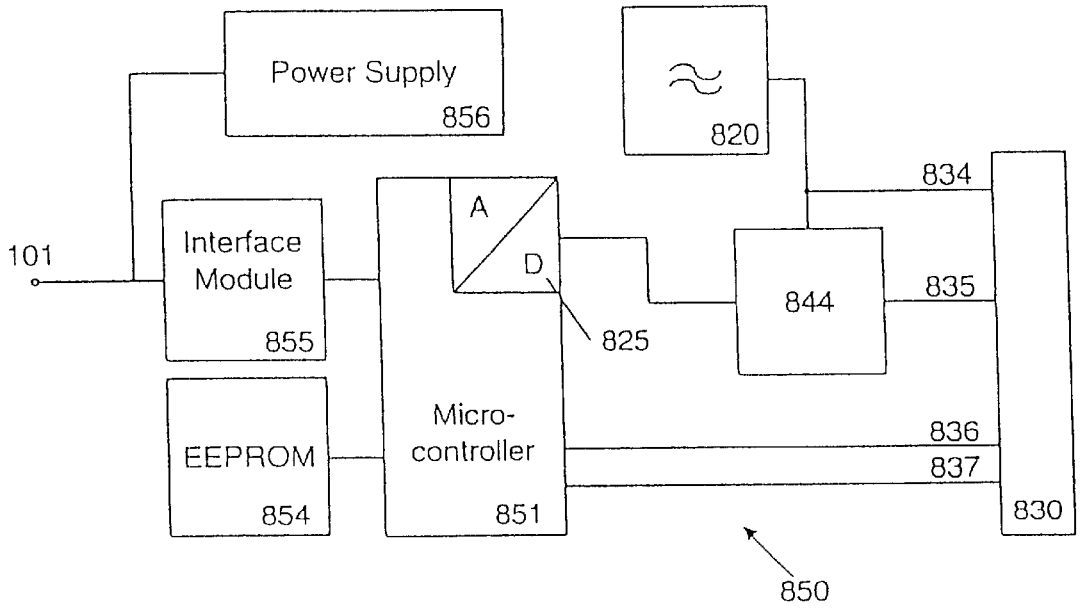
FIG. 11 is a block circuit diagram similar to that of FIG. 6 but for a controller for handling signals from a plurality of sensor modules as shown in FIG. 10.
Figure 12:
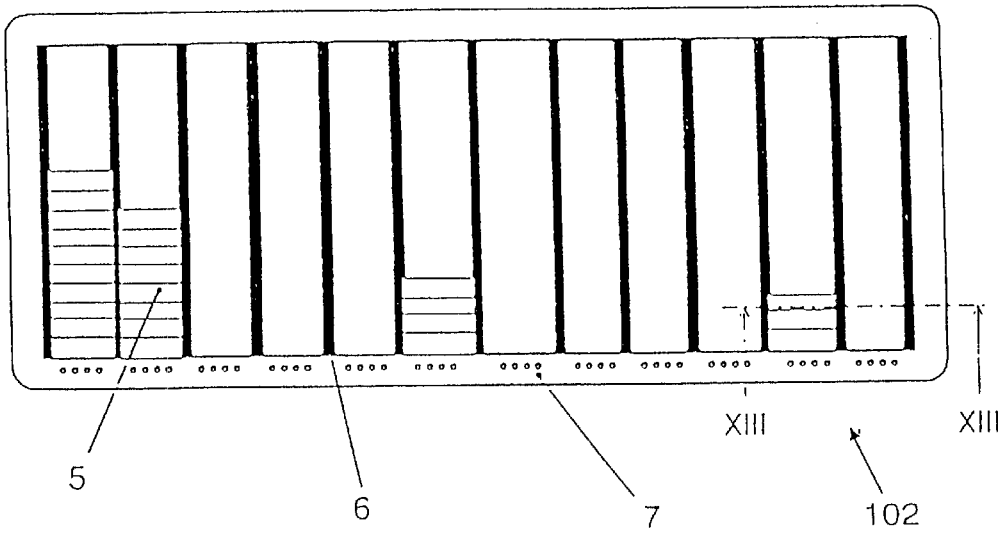
FIG. 12 is a plan view of a chip tray forming a gaming chip depository.

In the practical realization a plurality of sensors 801, typically four sensors, will be combined together into a sensor module 852 shown in FIG. 10 in accordance with the arrangement of the sensors on the table, i.e. in accordance with the four sensors 801 associated with the betting areas 110, 111 and the winning areas 112, 113 of the player's betting square 105. Each module has a signal input 830 and a signal output 831. The modules can thus be cascaded simply by connecting them in series. The first module is connected to a controller 850 as shown in FIG. 11, in similar manner to the connection of the sensor module 572 of FIG. 5 to the controller 750 of FIG. 6.

The sensor module 852 operates as follows: The sensors 201, 301 are supplied by the controller 850 of FIG. 11 via the line 834 with an alternating voltage. A preamplifier 822 is arranged directly alongside each sensor 801. The outputs of the amplifiers 822 can be selectively connected to the analog input line 835 of the controller via analog switches 832. The analog switches 832 are controlled via shift registers 833 which are cascaded together on connecting the modules 850 of FIG. 10 in series with each other. In order to interrogate the sensors, the controller 850 sends a single "one" bit with the aid of the data line 836 and the clock line 837 through the whole chain, and thus connects one switch 832 after the other to the analog input with each bit supplied.

The controller 850 has, in similar manner to the controller 750 of FIG. 6, a microcontroller 851 with an integrated analog/digital converter 825, a power supply 856, a serial interface 855 in the form of an interchangeable interface module which connects to the data processing system 104 via the table bus 101 and an EEPROM 854 for configuration and calibration data. Moreover, the oscillator 820 is provided at the controller and generates the alternating voltage for the sensors and the demodulator circuit 844 described with reference to FIG. 9. The interrogation of the individual sensors takes place, as previously described, via the lines 836 and 837.

Card Sensor

Figure 7:
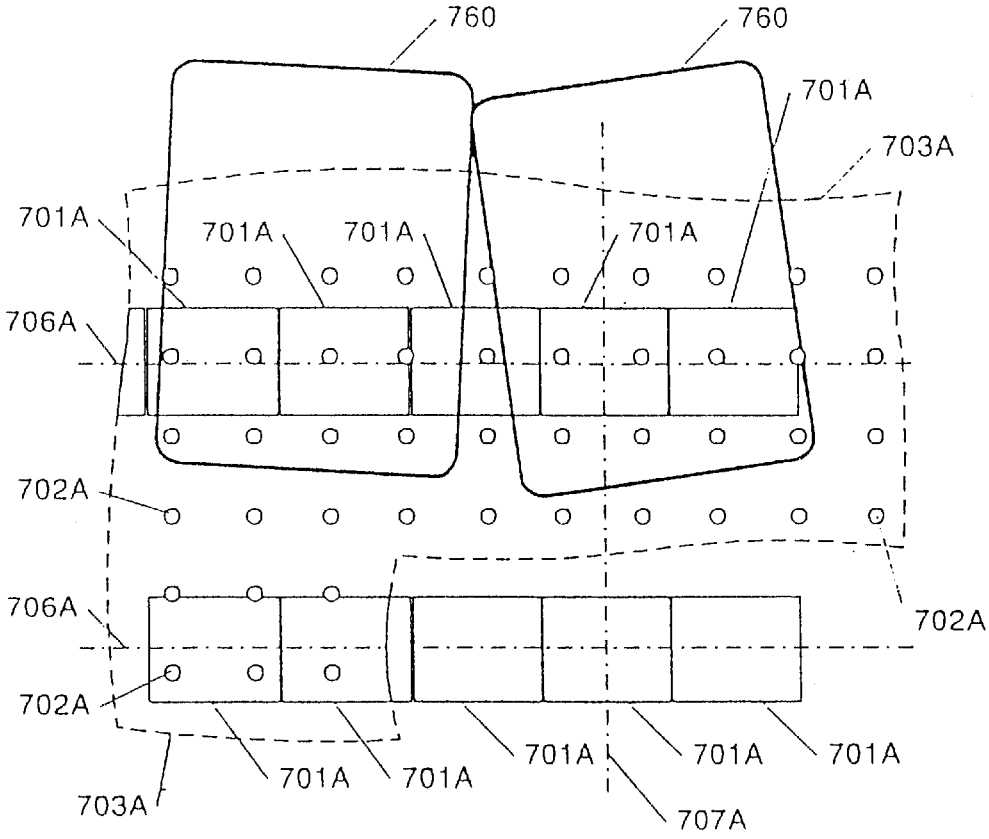
FIG. 7 is a schematic illustration of a card sensor.

The card sensor is illustrated in FIG. 7 and comprises a field of photoelements 701A arranged in a grid. The grid size is so selected that the resolution is sufficient to be able to distinguish between playing card 760 and two or more such playing cards placed on the field of photoelements 701A. In the example of FIG. 7 at least six and at most nine sensors are covered over by one card. Two cards lying alongside one another cover at least twelve sensors so that it is possible to distinguish unambiguously between no cards, one card and two cards present on the card sensor.

Since the photoelements 701A are located on the gaming table beneath the cloth 703A, the latter must be provided with apertures 702A in the region of the card sensor. The diameter and the grid spacing of the apertures 702A must be sufficiently small relative to the dimensions of the active surface of the photoelements that the size of the illuminated area of the photoelement does not change substantially with a small change in position of the cloth. In order to enable a flexible design of the field of photoelements 701A (so that it can be simply enlarged), the photoelements 701A of each row 706A or of each column 707A are collected together into a functional unit of the kind shown in FIG. 5. The diagram of FIG. 5 specially shows the sensor module 752 used to detect four different photoelements 701 of the two betting and win areas 110, 111 and 112, 113 of FIG. 2. Precisely the same circuit can, however, be used with the card sensor of FIG. 7 to detect the signals from a row 706A or a column 707A of photoelements 701A. This is indicated in FIG. 5 by the addition of the reference numeral 701A in brackets alongside the reference numeral 701 relating to FIG. 4. Since the circuitry of FIGS. 5 and 6 can be used with the card sensor of FIG. 7 in just the same way as with the sensors 101 of FIGS. 4 and 2, no further description is necessary.

Chip Tray or Gaming Chip Depository

A chip tray 102 in accordance with the invention is illustrated in FIGS. 12, 13, 14, and 15 and is manufactured, in the same way as the previously known similar apparatus, as a tray 202, for example of sheet steel, and has separators 6 which are inserted into it.

It is distinguished from the previously known devices in that a means is provided for determining the number of coins or coin-like articles 5 located in the chip tray 102. This means is formed by a plurality of transmitter/receiver pairs 641, 623 such as, for example, ultrasonic transmitters/receivers, light transmitters/receivers or the like, arranged substantially parallel to the jacket or envelope surfaces of the columns of chips which may be coins or coin-like articles.

Figure 13:
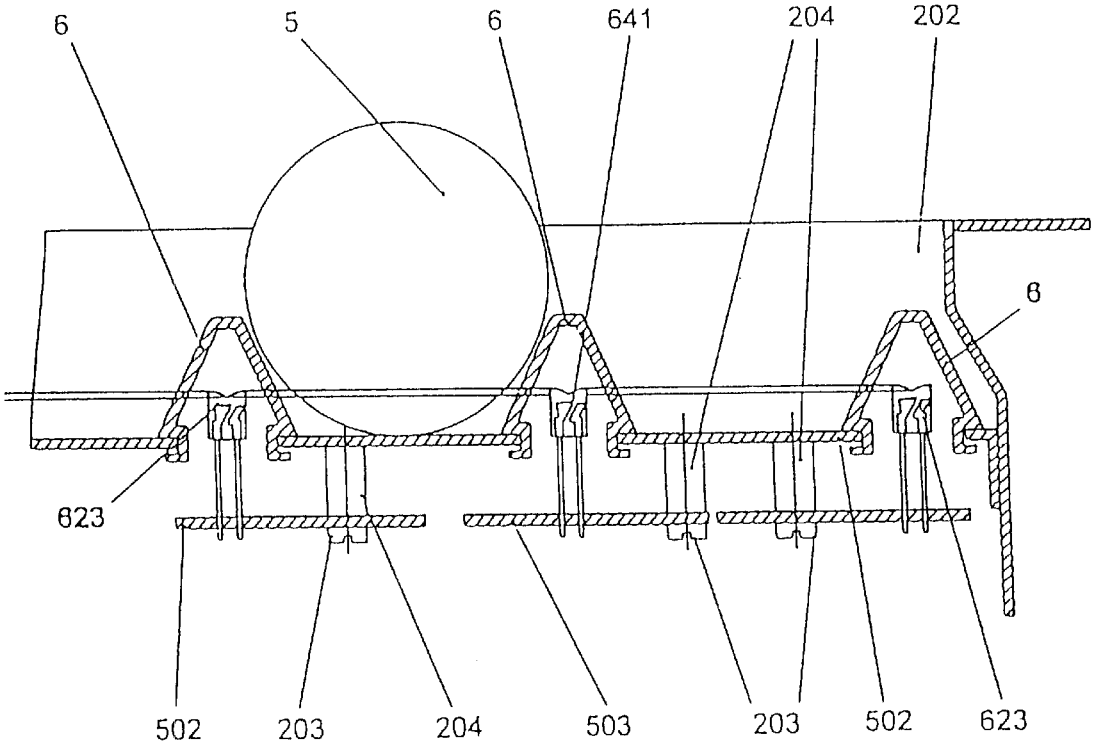
FIG. 13 is a partial cross-section through the chip tray of FIG. 12 on the line XIII—XIII.

As can best be seen from FIG. 13, the transmitter/receiver pairs 641, 623, which serve to determine the number of coins or coin-like articles 5 located in the device, are arranged inside the separators 6. A precondition for the orderly operation of this measurement device is naturally that the separators 6 consist of a material which is permeable for the wavelength radiated from the transmitters 623 and received by the receivers 641.

In the embodiment of the invention shown in the drawings, provision is made for only transmitters 623 or only receivers 641 to be arranged within each separator 6 and for separators 6 containing transmitters and receivers to be alternately arranged alongside one another.

This is realized in such a way that the transmitter 623 and the receiver 641 are arranged on plate-like modules 502, 503 respectively and these modules 502, 503 are fixed to the underside of the base of the tray 202 by means of securing bolts 203 and cylindrical spacers 204.

In order to explain the determination of the number of coins or coin-like articles 5 present in a column of the chip tray, the following description starts from the assumption that the transmitter/receiver pairs 641, 623 are formed by optical transmitters and receivers, namely infrared transmitters and receivers. With the aid of this transmitter/receiver arrangement, a "light-curtain" is formed which senses the column between the separators 6 transverse to the column direction.

Wherever coins or coin-like articles 5 are located, the light curtain is interrupted, i.e. the corresponding receivers 641 cannot receive any light from their associated transmitter 623. More specifically this means that a coin or coin-like article is located everywhere where a receiver 641 cannot receive light transmitted from the transmitter 623 associated therewith.

As a result of this scanning of the columns, it is also possible to track down columns which are not packed tightly in an orderly manner; gaps in the columns due to fanning out and also due to coins or coin-like articles 5 running crossways relative to the column are recognized by the gaps which arise in the otherwise closed column. A detection signal of this kind can activate a display and/or a shaker so that measures can be taken to establish the desired tightly packed build-up of the columns.

Figure 14:
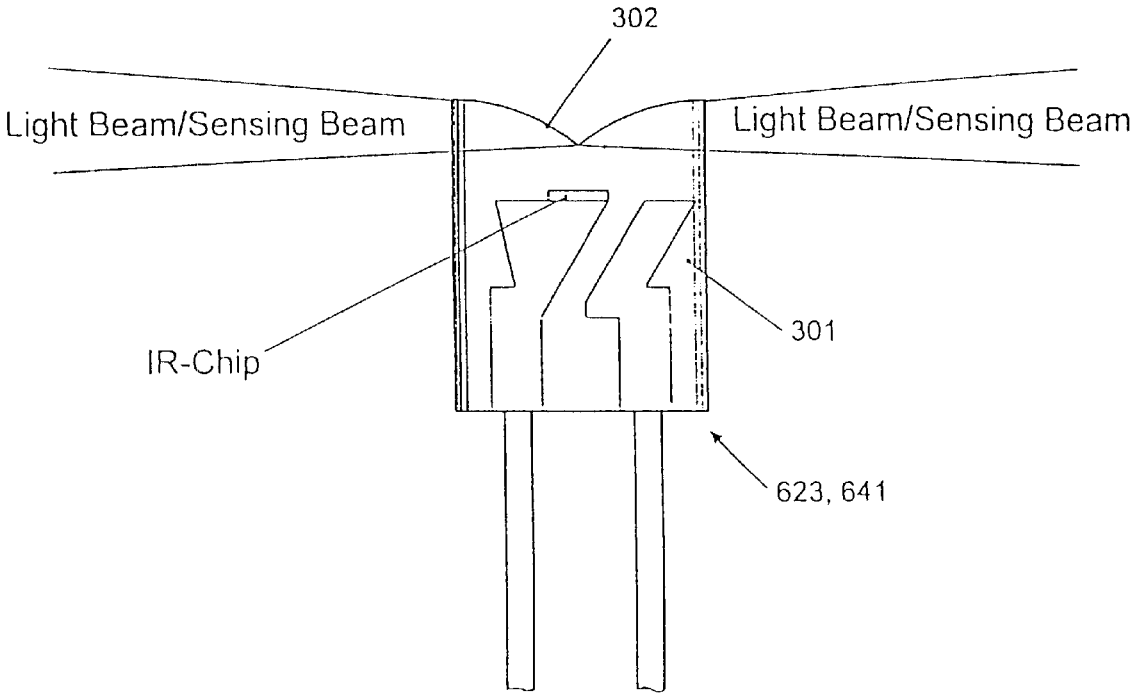
FIG. 14 is a schematic side elevation of a transmitter element as used in the chip tray of FIGS. 12 and 13.
Figure 15:
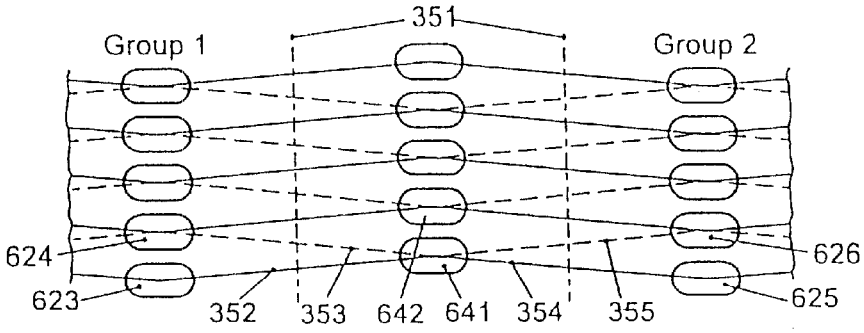
FIG. 15 is a schematic illustration of the transmitter and sensors of the chip tray of FIGS. 12 and 13 as seen in plan view.

As shown in detail in FIG. 14, the transmitters used in the embodiment of the invention shown in the drawings are so laid out that they transmit two light beams which extend displaced through 180° relative to one another and substantially transverse to the separators 6. Accordingly, the receivers also have two sensing lobes which are displaced relative to one another by 180° and extend substantially transversely to the separators 6. In this way a situation is achieved in which a transmitter 623 which is arranged between two columns can be simultaneously used for the sensing of both columns, that is to say, the two transmitters which would normally be necessary for this purpose can be replaced by a single element.

The afore-mentioned division of the transmitted light beam into two light beams at the transmitter element and the formation of two-sided sensing lobes at the receiver is realized by the shaping of the plastic housing 301. This housing is so laid out that the afore-mentioned beam distribution arises by reason of total reflection at the boundary layer 302 between the plastic and the environmental light.

As can be seen from FIG. 14 both the individual transmitters and also the individual receivers are arranged aligned with one another in rows with constant spacing.

In order to increase the sensing resolution, the receivers 641 are arranged displaced relative to the transmitters 623 by half the receiver-to-receiver spacing. Each receiver 641 thus forms light barriers with two transmitters 623 in each of its directions of sensivity. Through this arrangement, a resolution of a half-receiver-to-receiver spacing results in the centre of the channel indicated by chain-dotted lines 351. As a result of this alternate arrangement of transmitters 623 and receivers 641 in the chip tray 102, each receiver 641 is surrounded by two transmitters 623. In order to enable correct sensing, only a neighboring transmitter 623 may be activated for each receiver 641. The sensing of two columns with the aid of a transmitter 623 and receiver 641 arranged in accordance with FIG. 4 functions in the manner described in the following. For a better understanding of the explanation, the transmitters 623 are split up into two groups, termed here "group 1" and "group 2".

The receiver 641 lying at the lowermost point of the columns is activated. Thereafter the light beams 352, 353, 354, 355 are sent out in the following sequence:

1. The light beam 352 from the transmitter 623 of the group 1;
2. The light beam 353 from the transmitter 624 of the group 1;
3. The light beam 354 from the transmitter 625 of the group 2;
4. The light beam 355 from the transmitter 626 of the group 2.

The receiver 641 is subsequently deactivated, the receiver 642 lying above it is activated and the above steps are repeated analogously. In this manner, the total column length is sensed, the receiver data which is thereby obtained (light beam received or not received) is processed further by the control electronics, i.e. converted into the number of coins or coin-like articles 5 located in the columns. Clearly this system is expanded to cover all the columns of the chip tray 102.

The above assumption, namely that infrared transmitters and receivers are used, admittedly represents a particularly preferred embodiment of the invention. The invention is however in no way restricted to the same. In just the same way, ultraviolet waves, normal light waves, ultrasonic waves, laser waves, radar waves, or the like, can be used for the build-up of a "measurement curtain". The light transmitters and receivers 623, 641 will be understood to represent transmitters and receivers for other types of wave, so that separate transmitters and receivers for such other wave types are not shown.

Figure 16:
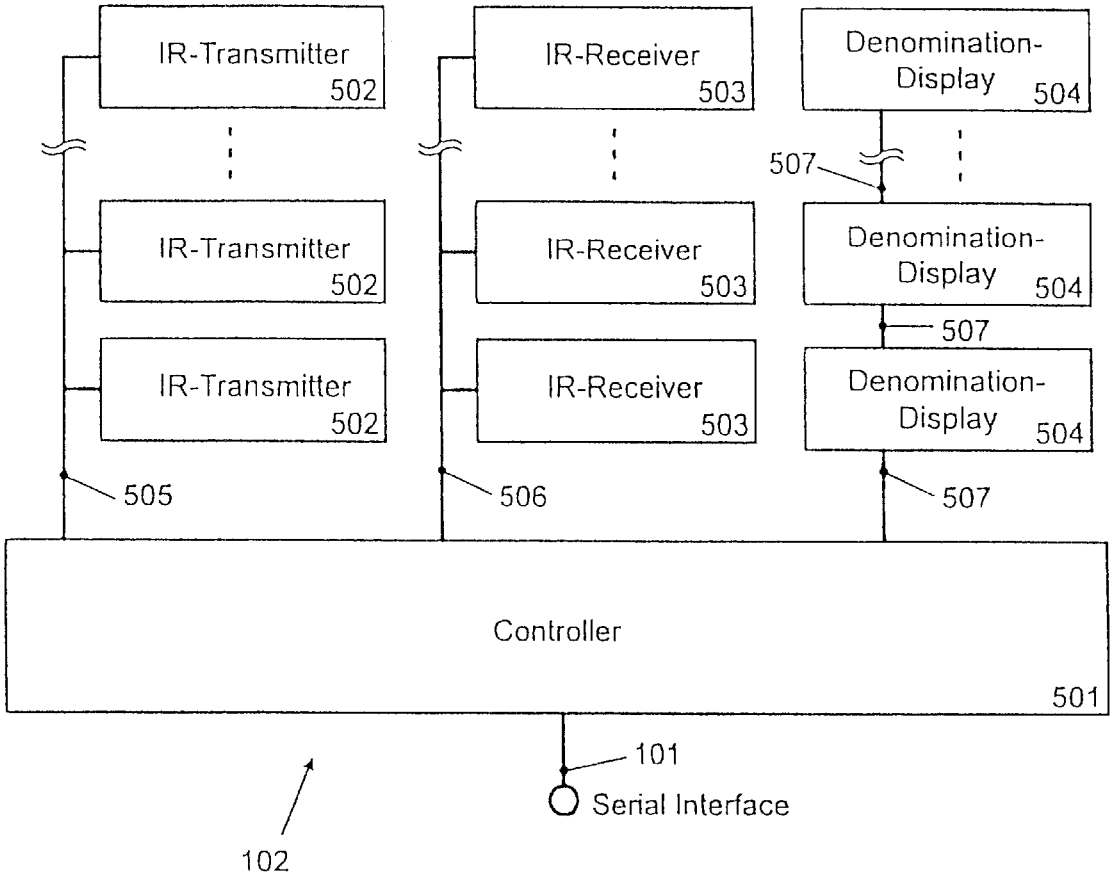
FIG. 16 is a block circuit diagram of a microcontroller for the chip tray of FIGS. 12 and 13.

The operation of the apparatus of the chip tray 102 is taken on by-a microcontroller 501 shown in block form in FIG. 16. This controls, on the one hand, the means for determining the number of coins or coin-like articles present in the apparatus and computes, on the other hand, the number of coins or coin-like articles contained in the apparatus from the signals received from the apparatus.

Such microcontrollers 501, which have been known per se for a long time in the prior art, should however preferably have an EEPROM 604 for the present application. The microcontroller 501 is connected here, as illustrated in FIG. 1*a*, to the table keyboard 100 as well as to the central processing unit 104. In addition, the microcontroller 501 is connected to optical display elements 504, so-called denomination displays, arranged beneath the columns. Denomination indications, such as the number of the coins or coin-like articles 5 contained in the respective column or the type or value of coins or coin-like articles 5 present in the column, can be displayed on these display elements 504.

Thus, the electronics of the apparatus illustrated schematically in FIG. 16 consists of the following constructional groups:

The microcontroller 501 makes available the supply voltages and control signals for the subordinate component groups (infrared transmitters and receivers, denomination displays) and evaluates the signals delivered back from the transmitters and receivers.

The microcontroller 501 can be connected via the serial interface 101 to a higher system, for example to a personal computer forming the data processing system 104. The detected data and the status and fault information of the chip tray 102 can be transmitted via the serial interface 101. In addition, the denomination displays 504 can be set and diverse configuration data can be transmitted to the microcontroller 501.

The transmitter modules 502 and the receiver modules 503 serve, as already described, for the scanning of the article columns. The transmitters 623 and receivers 641 controlled by the respective transmitter and receiver modules 502, 503 are—in each case alternatingly—mounted beneath the separators 6 between the columns. The transmitters and receivers are respectively connected via common bus cables 505 and 506 to the microcontroller.

The denomination displays 504 arranged beneath each column of the chip tray 102 are, for example, formed in the manner of a plurality of luminous diodes or of a numerical display which serves to indicate the chip value or type and the status of the columns. Several display units can also be located on one display module.

Figure 17:
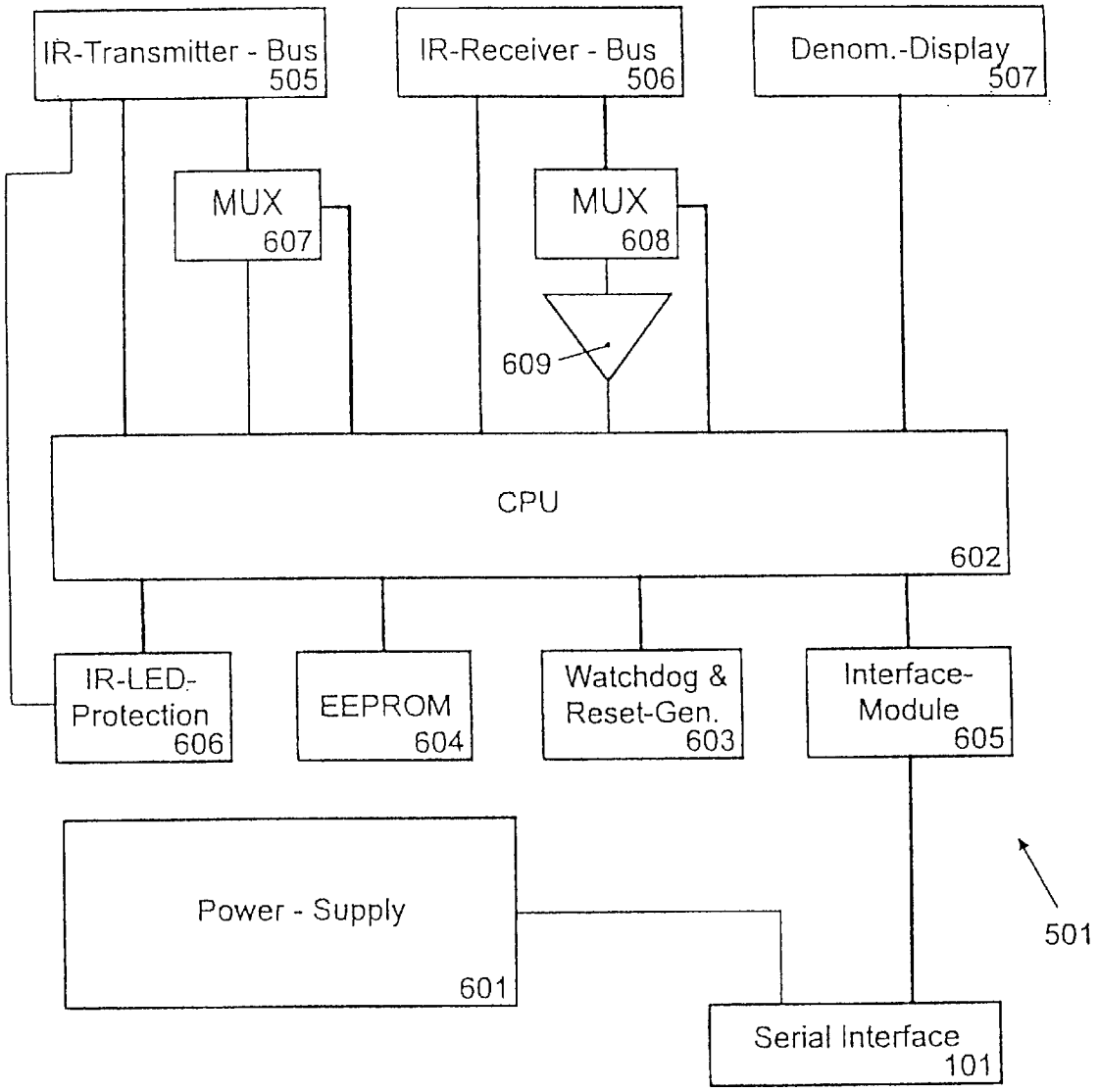
FIG. 17 is a more detailed block circuit diagram of the microcontroller of FIG. 16.

The precise layout of the microcontroller 501 is illustrated in FIG. 17 in the form of a block circuit diagram. The microcontroller 501 has a central processing unit CPU 602 which is connected to a monitoring module 603 having a reset generator. This is a so-called watchdog circuit, which monitors the correct operation of the microcontroller software. The serial interface 508 of the microcontroller 501 can be matched to various standards (for example RS485 or RS232) by plugging in an interface module 605. Important configuration and calibration data are stored in a non-volatile memory in the form of the EEPROM 604. Large component tolerances arise, with optical semiconductor elements in particular. In order to compensate these, the sensitivities of all the resulting light barriers are measured in a calibration procedure, are stored in the EEPROM 604 and are used as reference values during the evaluation of the measured values from the light barriers in sensing operation.

Since the transmitter diodes of the infrared transmitters are operated with high pulse currents, and since permanent switching-on of the diodes as a result of a fault at the microcontroller 501 would lead to the transmitter modules being damaged, a protection circuit 606 is provided which deactivates the transmitters on exceeding a certain maximum switch-on duration.

The multiplexer 607 serves to select one of the infrared diode monitoring signals delivered by the transmitter modules 502 on the transmitter bus 505. The multiplexer 608 in the receiver circuit serves for the selection of an (analog) receiver output signal on the receiver bus 506. After a level adaption 609, the selected signal is supplied to the internal analog/digital converter of the CPU 602. The reference numeral 601 represents a power supply for the chip tray 102 and can be integrated into the power supply for the other items of apparatus, such as 756 in FIG. 6 and 856 in FIG. 11.

Figure 18:
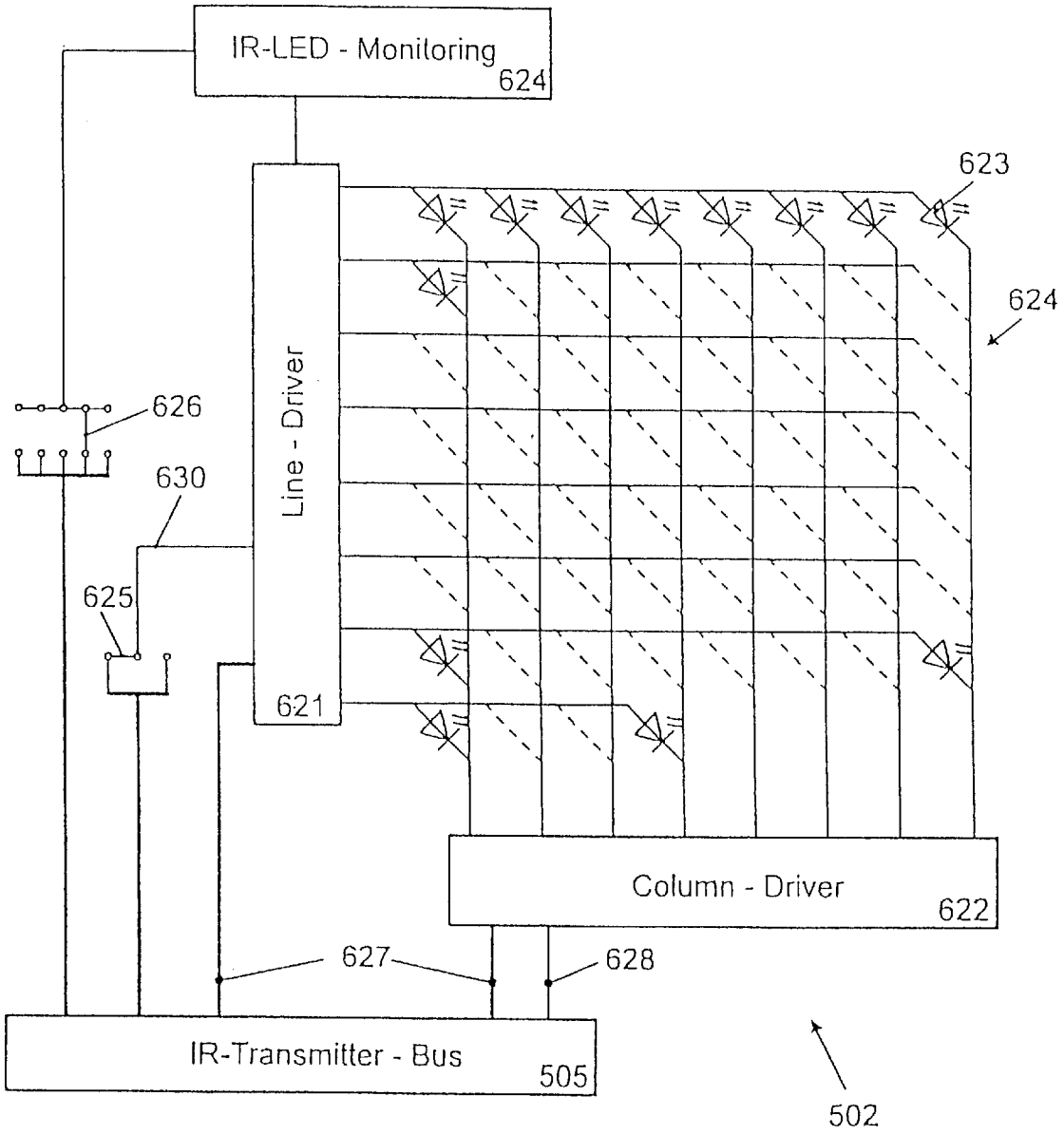
FIG. 18 is a block circuit diagram illustrating the control of the transmitters of FIG. 15.

A possible embodiment of the transmitter module 502 is shown in detail in FIG. 18. The infrared diodes 623 of the transmitter module 502 are electrically arranged in a matrix 629. In addition to the address lines 627, the row and column drivers 621, 622 also have a release line 628, 630. The transmitter module 502 is switched on only when both drivers 621, 622 are activated.

With the aid of the release line 630 of the row driver 621, the module is associated with one of the two above-mentioned groups, which association is achieved by a corresponding setting of the jumper (bridge piece) 625. The precise switch-on time or switch-on duration is determined by a release pulse to the column driver 622.

In order to be able to recognize defective infrared diodes 623, the transmitter current is checked by a monitoring circuit 624. The output signal of the current monitoring circuit 624 is associated via a jumper (bridge piece) 626 with one of the corresponding input lines of the controller 501, independently of the mechanical position of the transmitter module 502.

Figure 19:
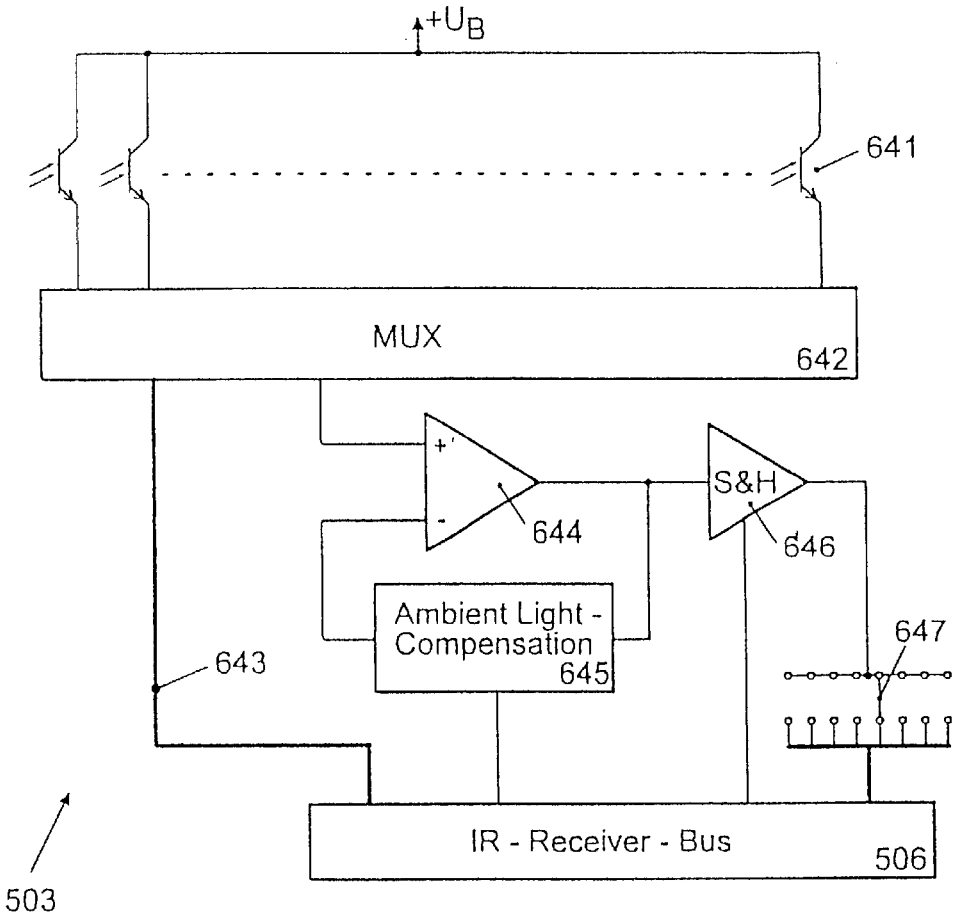
FIG. 19 is a block circuit diagram illustrating the control of the receivers of FIG. 15.

A receiver module 503 is shown in detail in FIG. 19. The selected phototransistor 641 is connected to the measurement amplifier 644 via an analog multiplexer 642 which is controlled by the controller 501 via a part 643 of the receiver bus 506. Prior to the actual measurement, a DC light calibration is carried out by means of an active compensation circuit 645, i.e. the measurement result is free from the influences of ambient light.

With the activation pulse of the infrared transmitter, the sensing and holding member 646 is simultaneously opened which temporarily stores the measured brightness value prior to interrogation and quantization by the controller 501. The output of the receiver at the sensing and holding member 646 is associated by means of a jumper (bridge piece) 647 with a specific input of the controller 501 in accordance with the mechanical position of the receiver module 503 in the chip tray.

Figure 20:
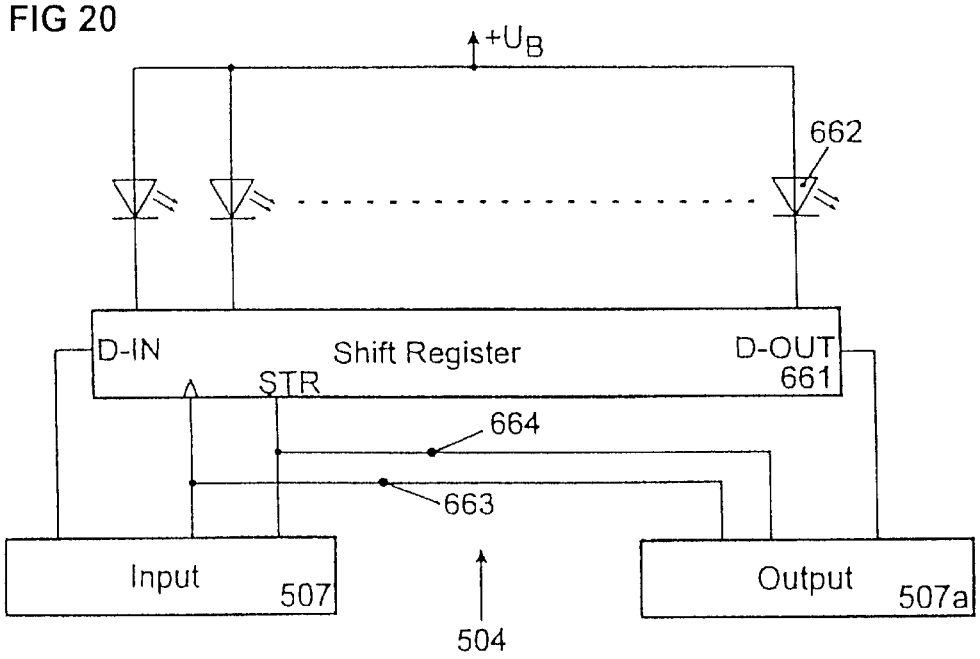
FIG. 20 is a block circuit diagram showing the control of the display elements of the chip tray in detail.

The layout of the denomination display 504 is illustrated in FIG. 20. This uses a shift register 661 with an integrated intermediate memory. The data is written into the shift register 661 by means of a clock signal 663 and is taken into the display by means of a release pulse 664.

As indicated earlier, the electronic chip tray 102 is located at a gaming table as shown in FIG. 1 and can be served via the table keyboard 100 which is likewise installed at the gaming table. The data lines of the electronic chip tray 102 and also of the table keyboard 100 are connected via the interface 101 to a communication processor 103 (FIG. 1*a*) and from there to the system computer 104.

The necessary configurations of the chip tray 102, such as the chip value, chip thickness or the like, are either fed in at the input terminal 100 or can be determined at the system computer 104 and communicated to the microcontroller 501 for the chip tray 101.

The said monitoring of the table games takes place in such a way that the performance of a croupier or dealer, i.e. the value of his gaming proceeds, is detected. For this purpose, the so-called "table inventory" must be observed and recorded. The table inventory of a gaming table comprises the following:

The supply of gaming chips or simply "chips" which are located with most game types in the chip tray 102 within the reach of the dealer, and the cash of the "dropbox" in which the payments are deposited when purchasing chips.

It is the object of the chip tray 102 to automatically determine the supply of chips at the gaming table.

All non-game dependent changes in the chip inventory, such as chip movements from the chip bank to the table and back to the chip bank "Fills" and "Credits", "Markers" for the handing out of chips to players in exchange for in-house checks, are passed on to the data processing system manually via the input terminal 100. The cash present in the "dropbox" is determined by summing up the "drops" (the deposits for each sale of chips by the dealer).

In this manner, the total value of the inventory which is instantaneously present on or at the table and in the chip tray can be determined.

In order to determine the performance of each individual croupier, dealer, or table team, the table inventory must be determined for each change of the croupier, dealer, or team (dealer change). If such a dealer change is effected, then the new dealer identifies himself at the table terminal 100, for example by means of his magnetic card, i.e. advises the data processing system of the change. Thus, the takings of each dealer can be calculated.

Extract from the "Rules of Play" in Casinos in British Columbia

Procedures set out in this Section shall be used in British Columbia casinos. Proposed changes must be submitted in writing for approval by the Branch at least 21 days in advance of proposed implementation.

BLACKJACK (a) General Description

Blackjack is a card game in which each player attempts to achieve a higher total point value per hand than the Dealer without exceeding a value of 21. If value of hand exceeds 21, it is a "bust" and the bet is automatically lost. If player and dealer have equal value hands, it is a "push" and nobody wins or loses. The game shall be played utilizing a "shoe" holding at least four decks. Up to seven players may participate, depending on the table layout. Only the Dealer shall touch cards.

(b) Card Values

Aces may count 1 or 11 at player's election. Face cards count 10 and all other cards are face value.

A soft hand is one containing an ace which, if counted as 11, will not cause the hand value to exceed 21.

If the first two cards dealt to a player total 21, the player has a "natural" or "Blackjack," this wins over any three or more card total of 21. If player and Dealer have a "Blackjack," it is a "push."

(c) Player Options

Each player receives two cards, face-up. Dealer takes one card, face-up, after which each player has the following options:

(i) Take a "hit" by signalling for additional cards. A Blackjack cannot be "hit."

(ii) "Stand" by signalling no additional cards.

(iii) "Double down" by putting up an additional bet equal to the original bet. This second bet is placed directly behind the original bet. The player receives only one additional card which the dealer places at the rear right of the player's hand. Player may not double down on a Blackjack. When Dealer has a Blackjack, player loses only original bet.

(iv) "Pair Splitting"—may be done when first two cards dealt are of equal value. Player puts up an additional bet equal to the initial bet. The second bet is placed directly beside the original bet.

Player plays each as a separate hand. The first split hand is played out before the second hand is played. Split aces are limited to one additional card per hand. When the dealer makes Blackjack, only the original bet on a split hand is lost. A two-card 21 on a split hand is not a Blackjack and is paid one to one.

(d) Betting And Limits (i) At least one third of blackjack tables shall have a minimum bet of $1.00. No more than four blackjack tables shall have a maximum betting limit in excess of $25.00 with all other tables at a maximum bet of $5.00.

(ii) Where betting limits are changed during a day, prior to the change taking place the procedures for "Table Close", Section 2.3.1, "Interim Drop Box Pull", Section 2.2.5 (only box from that table to be pulled), and "Table Opening", Section 2.1.3, shall be followed.

(iii) Bets are valid only when placed in betting square on table layout before dealing commences. Bets shall remain unchanged during play (except when splitting or doubling down).

(iv) "Insurance bets" and "bet for the dealer" are not allowed.

(e) Sequence of Play

Starting on Dealer's left, each player is dealt one card, face-up. Dealer takes one card, face-up, and proceeds to deal second face-up card to each player, again from left to right. Dealer places players' cards in front of betting square. Dealer's hand is laid out in front of chip tray.

Additional cards are dealt left to right to players who signal for same by a hand motion towards themselves. Players wishing to stand will motion by hand away from themselves.

After all players' hands are complete, the Dealer:

(i) Does not play if:

all players have busted remaining players have Blackjack and Dealer's first card is neither an ace or 10 value card (ii) Otherwise takes additional cards face-up, one at a time, including on a "soft" 17.

(iii) Stands if the hand is hard 17 or more, including hard or soft totals of 18, 19, 20, 21.

When all bets are paid or taken, Dealer picks up remaining hands in order from right to left and own hand last. All cards are placed in discard rack.

Payoffs

All winning hands are paid one to one, except a Blackjack which is paid off at three to two.

When all hands, including Dealer's, have been played winning bets are paid and losing bets taken starting with player on Dealer's right and continuing left. Dealer will signify pushes by patting the table in front of player's hand. Payoffs will be made on a "color for color" basis.

Busted hands during play result in the player's bet being taken immediately and cards placed in discard rack, except in cases of a split or double down hand when the Dealer has a first card ace or 10.

In such instances, the players' bets and cards remain on the table with Dealer placing corresponding bet on top. Should Dealer make a Blackjack, only original bet of split hand or double down is taken.

Players who are dealt a Blackjack are paid off immediately and cards placed in discard rack unless the Dealer has an ace or 10, in which case players' bets are placed on top of their cards until Dealer's hand is played out to determine if a push may occur.

(g) Change-Ins (i) Dealer shall not accept cash or value chips from player by hand. Player shall place cash or value chips on table for pick-up by Dealer. Dealer shall count cash or value chips onto table from left to right in front of chip tray. The equal value of value chips is taken from tray and stacked on table in front of tray with highest denomination on top and lowest on bottom.

(ii) Stack is then placed in front of player, and cash picked up by Dealer and placed in drop box or, in case of value chips, in tray.

(iii) When accepting cash for value chips, Dealer calls out "money change" and when changing player's value chips for higher or lower denominations, Dealer calls out "color change."

(h) Cards

All cards shall be inspected for flaws and ribbon spread prior to opening by Dealer who inspects for flaws. Cards remain ribbon spread, face-up until play commences.

If game goes temporarily dead, cards are to be removed from shoe and discard rack and ribbon spread, face-up, on table.

Should a game be closed temporarily, or at closing, shoe and cards are removed by Pit Boss to secure storage.

(i) Disputes and Irregularities

Where a dispute arises between player and Dealer over interpretation of a hand signal, Dealer immediately notifies Dealer Supervisor. Dealer Supervisor either allows player who has missed hit card to take additional hits after all other players have completed their hands but before Dealer plays out hand, or, when player's hand has been hit by mistake, declares that hit card dead and instructs Dealer to burn it and the player's hand stands.

In cases of hand signal disputes, the player must notify the Dealer of objection before Dealer's hand is played.

Players not in agreement with a decision may contact the Branch in writing.

(j) Shuffle (i) Prior to commencement of play, Dealer thoroughly shuffles cards. This procedure starts with Dealer calling out the words, "shuffle up" to notify Dealer Supervisor.

(ii) All cards remain face down during shuffle.

(iii) All cards are stacked in the middle of the table and split into approximately two equal stacks which are placed at the front left and right corners of chip tray.

(iv) Dealer takes approximate half decks at a time from each of the two piles, riffle shuffles these together, square and strip cuts, then riffle shuffles another 2 or 3 times. When all decks have been shuffled in this manner, Dealer squares cards in middle of the table and allows a player to insert cut card into deck.

(v) Dealer places the cards in front of the cut cards at the back of the deck.

(vii) Dealer once again squares cards and inserts cut card 35 to 55 cards from back of deck if using 4 decks or 55 to 78 cards if using 6 decks. Deck is then placed in shoe for dealing.

(viii) When cut card appears during play, Dealer will finish hand in progress and "shuffle up" as per instructions above.

(k) "Dead" Game

When a game has no players, the Dealer shall place a locking lid over the value chip inventory. The Dealer shall remain at the game until relieved or the game is closed.

What is claimed is:

1. An apparatus for determining at least one of the amount bet, or the amount won or lost by individual participants in a game of chance that uses cards, wherein the amounts bet and won are represented by gaming chips, the apparatus comprising:

a central chip depository for receiving the gaming chips, means for determining a monetary value of the gaming chips in the central chip depository, at least one chip deposit area per participant, a play status sensor for detecting the start of a gaming hand;

means to determine which participants lost a hand at a first stage of a hand, at least one presence sensor associated wit each chip deposit area for the detection of one or more chips lying on this deposit area, the presence sensor being incapable of receiving radio transmissions from any gaming chips, and a data processing system to which said means for determining the monetary value of the gaining chips in the central chip depository and also said at least one presence sensor are connected, said data processing system being adapted to estimate the average amount bet or the amount won or lost by individual participants in said game of chance from the change in value of the gaming chips in the central chip depository.

2. An apparatus in accordance with claim 1 wherein said central chip depository and said chip deposit area for each participant are provided at a gaming table.

3. An Apparatus in accordance with claim 1, wherein at least one deposit area is provided per participant for the placement of the chips being bet.

4. An Apparatus in accordance with claim 1, wherein at least one deposit area is provided per participant for the deposition of the chips that are won.

5. An Apparatus in accordance with claim 3, wherein at least one deposit area is provided per participant for the deposition of the chips that are won and wherein the chip deposit areas of each participant for chips bet and won are combined into a regular arrangement.

6. An apparatus in accordance with claim 1, wherein the play status sensor is connected to an input of the data processing system.

7. An Apparatus in accordance with claim 6, wherein said play status sensor comprises a card sensor activated by one or more cards dealt by the dealer to himself.

8. An apparatus in accordance with claim 1, further comprising a table keyboard communicably connected to the data processing system.

9. An apparatus in accordance with claim 8, wherein said at least one presence sensor have outputs and are connected via a first interface and a second interface to said data processing system; and wherein the table keyboard is connected via said first interface to said data processing system.

10. An apparatus in accordance with claim 1, wherein said sensors are selected from the group comprising force pick-ups, inductive presence sensors, capacitive sensors, sender-receiver pairs, and video pattern recognition systems.

11. An apparatus in accordance with claim 1 wherein the means to determine which participants lost a hand at a first stage of a hand comprises the at least one presence sensor associated with each chip deposit area.

* * * * *